US005382016A

United States Patent [19]

Kobayashi et al.

[11] Patent Number: 5,382,016

[45] Date of Patent: Jan. 17, 1995

[54] SHEET SORTER WITH A STAPLER HAVING A CONTROLLED SHEET ALIGNING MEMBER

[75] Inventors: Kenji Kobayashi, Tokyo; Koichi Murakami; Masakazu Hiroi, both of Yokohama; Naho Wakao, Machida, all of Japan

[73] Assignee: Canon Kabushiki Kaisha, Tokyo, Japan

[21] Appl. No.: 143,250

[22] Filed: Oct. 29, 1993

Related U.S. Application Data

[63] Continuation of Ser. No. 892,721, May 29, 1992, abandoned, which is a continuation of Ser. No. 666,457, Mar. 5, 1991, abandoned, which is a continuation of Ser. No. 321,842, Mar. 10, 1989, abandoned.

[30] Foreign Application Priority Data

| | | | |
|---|---|---|---|
| Mar. 11, 1988 | [JP] | Japan | 63-057807 |
| Mar. 11, 1988 | [JP] | Japan | 63-057808 |
| Mar. 11, 1988 | [JP] | Japan | 63-057809 |
| Mar. 11, 1988 | [JP] | Japan | 63-057810 |
| Mar. 11, 1988 | [JP] | Japan | 63-057811 |
| Mar. 11, 1988 | [JP] | Japan | 63-057812 |
| Mar. 12, 1988 | [JP] | Japan | 63-058676 |

[51] Int. Cl.[6] ..... B65H 39/10

[52] U.S. Cl. ..... 271/293; 271/221; 271/223; 271/294; 270/53; 270/58

[58] Field of Search ..... 271/221, 222, 223, 265, 271/287, 288, 292, 293, 294, 298, 303; 270/53, 58

[56] References Cited

U.S. PATENT DOCUMENTS

| | | | |
|---|---|---|---|
| 3,658,324 | 4/1972 | Snellman | 271/287 X |
| 4,009,071 | 2/1977 | Snellman | 270/58 X |
| 4,325,544 | 4/1982 | Magno et al. | 271/223 |
| 4,332,462 | 6/1982 | Yagasaki et al. | 271/265 X |
| 4,376,529 | 3/1983 | George et al. | 270/53 |
| 4,385,827 | 5/1983 | Naramore | 271/292 X |
| 4,424,963 | 1/1984 | Bartholet et al. | 270/53 |
| 4,444,491 | 4/1984 | Rinehart et al. | 270/294 X |
| 4,473,219 | 9/1984 | Ichikawa | 270/53 |
| 4,621,799 | 11/1986 | Bastow et al. | 271/265 X |
| 4,681,310 | 7/1987 | Cooper | 271/293 X |
| 4,751,550 | 6/1988 | Murakami | 355/14 SH |
| 4,762,312 | 8/1988 | Ushirogata | 270/53 |
| 4,782,363 | 11/1988 | Britt et al. | 270/53 X |
| 4,801,133 | 1/1989 | Ishiguro et al. | 270/53 |
| 4,930,761 | 6/1990 | Naito et al. | 270/53 |
| 4,962,920 | 10/1990 | Kitajima et al. | 271/293 |

FOREIGN PATENT DOCUMENTS

| | | | |
|---|---|---|---|
| 198970 | 10/1986 | European Pat. Off. | 270/53 |
| 301596 | 2/1989 | European Pat. Off. | 270/53 |
| 86551 | 5/1984 | Japan | 271/287 |
| 119069 | 5/1987 | Japan | 270/53 |
| 191374 | 8/1987 | Japan | 271/287 |
| 117870 | 5/1988 | Japan | 270/53 |
| 2173483 | 10/1986 | United Kingdom | 271/293 |

*Primary Examiner*—Robert P. Olszewski
*Assistant Examiner*—Boris Milef
*Attorney, Agent, or Firm*—Fitzpatrick, Cella, Harper & Scinto

[57] ABSTRACT

A sheet sorter with includes a bin unit including a plurality of bins for accommodating sorted sheets, sheet stacker for accommodating non-sorted sheets, sheet switcher for selectively guiding the sheets to the plural bins or to the sheet stacker, stapler for stapling the sheets accommodated in the bins, for each of the bins, and controller for controlling the sheet switcher to direct the sheet to the bins in response to instructions for sorting and stapling the sheets, to direct the sheet to the sheet stacker in response to instructions for accommodating the sheets without sorting, and to direct the sheets to the bin unit in response to instructions for stapling the sheets without sorting. The apparatus further includes a reciprocating aligning member which is driven to an alignment position during movement of the bins and is again driven to the alignment position to complete the aligning operation after completion of the movement of the bins.

18 Claims, 25 Drawing Sheets

SHEET SORTER WITH A STAPLER HAVING A CONTROLLED SHEET ALIGNING MEMBER

This application is a continuation of application Ser. No. 07/892,721 filed May 29, 1992, which is a continuation of application Ser. No. 07/666,457 filed Mar. 5, 1991, which is a continuation of application Ser. No. 07/321,842 filed Mar. 10, 1989, all now abandoned.

FIELD OF THE INVENTION AND RELATED ART

The present invention relates to a sheet sorter with a stapler for sorting and stapling sheets discharged from an image forming apparatus such as a copying machine and a printer to which it is connected.

A sheet sorting and stapling apparatus is known which is coupled with an image forming apparatus such as a copying machine and a printer and which receives and sorts and the sheets discharged from the copying apparatus and can staple the sheets for each of the bins.

Such a sheet sorting and stapling apparatus is provided with a number of bins which are vertically movable and is provided with a stapler which can move into and away from the sheet stacking portions of the bins. The copy sheets discharged from the copying machine are simply received by the bins, or the copy sheets received by the bins are stapled for each of the bins, depending on a selected mode among various modes, for example, a sorting mode wherein the sheets are sorted and received by the bins and a grouping mode wherein the copy sheets from each of the originals are accommodated.

Some of such a sheet sorting and stapling apparatus is such that when one set copy is produced from one set of originals (one copy mode), the copy sheets discharged from the copying machine are not sorted and are discharged to a discharge tray which is separate from the bins. In such an apparatus, the stapler capable of stapling the copy sheets received by the bins can not staple the copy sheets discharged to the separate discharge tray.

SUMMARY OF THE INVENTION

Accordingly, it is a principal object of the present invention to provide a sheet sorter with a stapler capable of stapling the sheets not sorted.

According to one aspect of the present invention, there is provided a sheet sorter with a stapler including a plurality of bins for receiving sorted sheet, a sheet stacked for stacking non-sorted sheets, means for selectively distributing the sheets to the bins or to the sheet stacker and means for stapling the sheets received by the bins; and including control means for switching the sheet distributing means to the bin side in response to instructions for sorting and stapling the sheets, for switching said sheet distributing means to the sheet stacker side in response to instructions for not sorting the sheets, and for switching the sheet distributing means to the bin side in response to instructions for stapling the sheets without sorting. When the sheets are to be stapled without sorting, the sheet distributing means is switched to the bin side although the sheets are not to be sorted. Therefore, a set of copies formed in the one copy mode, which are conventionally unable to be stapled, can be stapled without modification to the structure of the stapling means and others.

According to another aspect of the present invention, there is provided a sorter wherein the bins are moved using a rotatable member provided with a helical cam having parallel portion and wherein when a mode for moving the bins upwardly is selected, the helical cam moves the cam engaging portion to an upward movement stand-by position which is in the parallel portion and adjacent to a portion which is inclined toward a bins rising direction, whereas when a bin lowering mode is selected, the helical cam moves the cam engaging portion to a downward movement stand-by position which is adjacent to a portion in the parallel portion and adjacent to a portion which is inclined to the bin lowering portion, by control means. By this, the bin movement cam start immediately after the start of the helical cam rotation, so that the bin movement can be effected without delay, whereby the overall speed of the bin movement is increased. This is particularly advantageous when high speed image formation is desired.

According to a further aspect of the present invention, there is provided a sorter having a stapler movable at least between a stapling position for stapling sheets and a retracted position for permitting movement of the bins, and control means for moving the stapler to a staple exchanging position when the staples are to be replenished. Then, the staple replenishing operation is easy.

According to a further aspect of the present invention, there is provided a sorter including an aligning member for aligning the sheets by abutment to the edges of the sheet accommodated in the bins, and control means for starting to drive the aligning member during the driving of a bin moving means, and for completing the aligning operation by the aligning member reaching the aligning position, after completion of the driving of the bin moving means. By this, during the bin movement, the aligning member is not positioned at the aligning position, and therefore, the sheets accommodated in the bins are not disturbed by movement of the bins, and therefore, the sheets are aligned in good order.

According to a further aspect of the present invention, there is provided a sheet sorter including a curl confining means for confining curling of the sheets accommodated in the bins, wherein the curl confining operation is completed later than the completion of alignment operation by the aligning means. By this, movement of the sheets are not obstructed by the curl confining means.

According to a further aspect of the present invention, there is provided a sheet sorter wherein the stapling device is moved to the operating position after the curl confining means confines the curl of the sheet. By this, the curled portion of the sheet is prevented from contacting the stapling device resulting in the sheet being undesirably folded or disturbed.

According to a further aspect of the present invention, there is provided a sorter including detecting means for detecting whether the stapling device is at the operating (stapling) position or at the retracted position, wherein when it detects the operating position, the detecting means shuts off the power supply to the bin moving means (a helical cam rotatable member). By this, the moving means can be assuredly stopped, and therefore, the bin is prevented from being damaged. In addition, the detecting means is effectively used without increase of cost.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
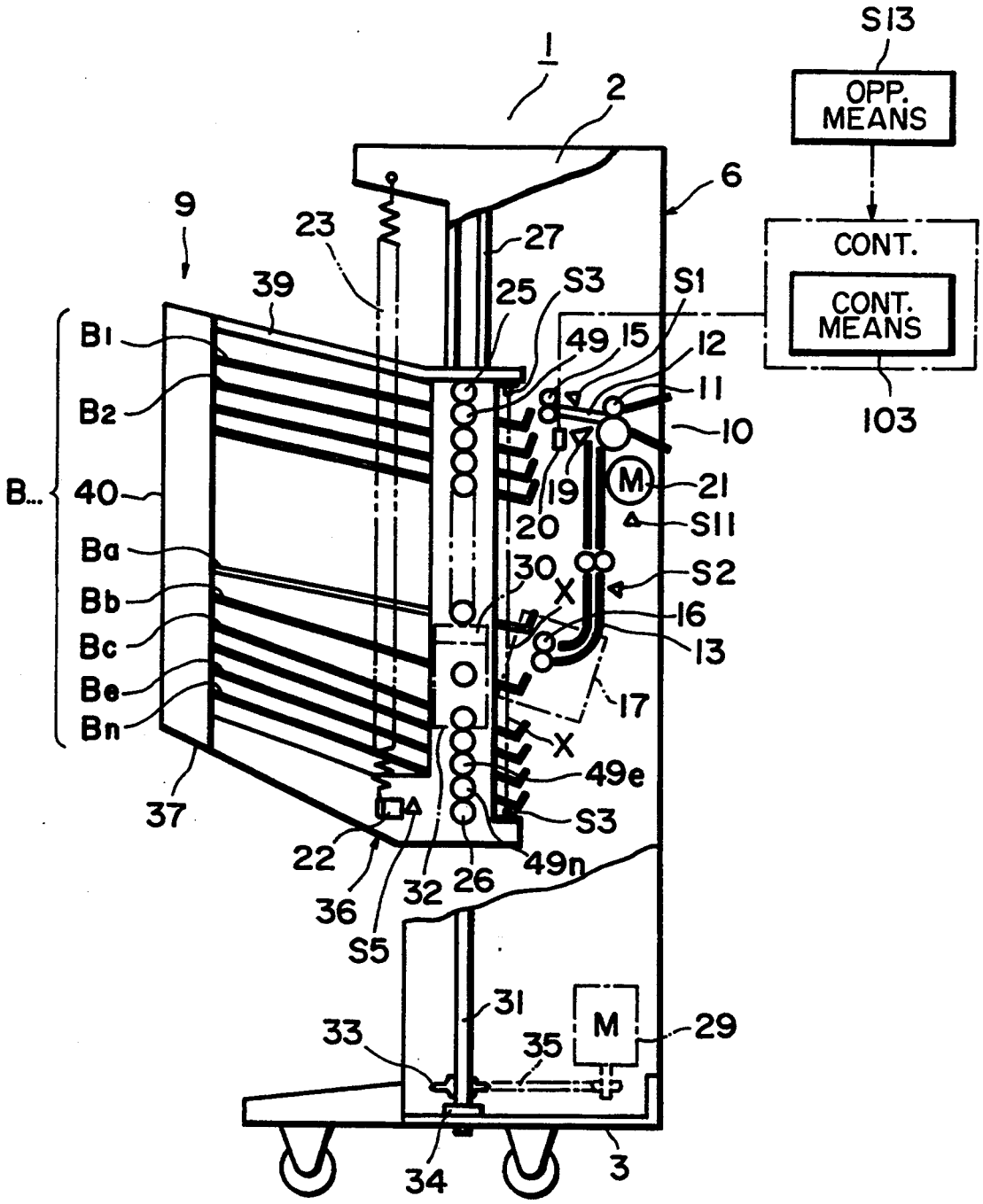
FIG. 1 is a side view of a sorter according to an embodiment of the present invention.
Figure 2:
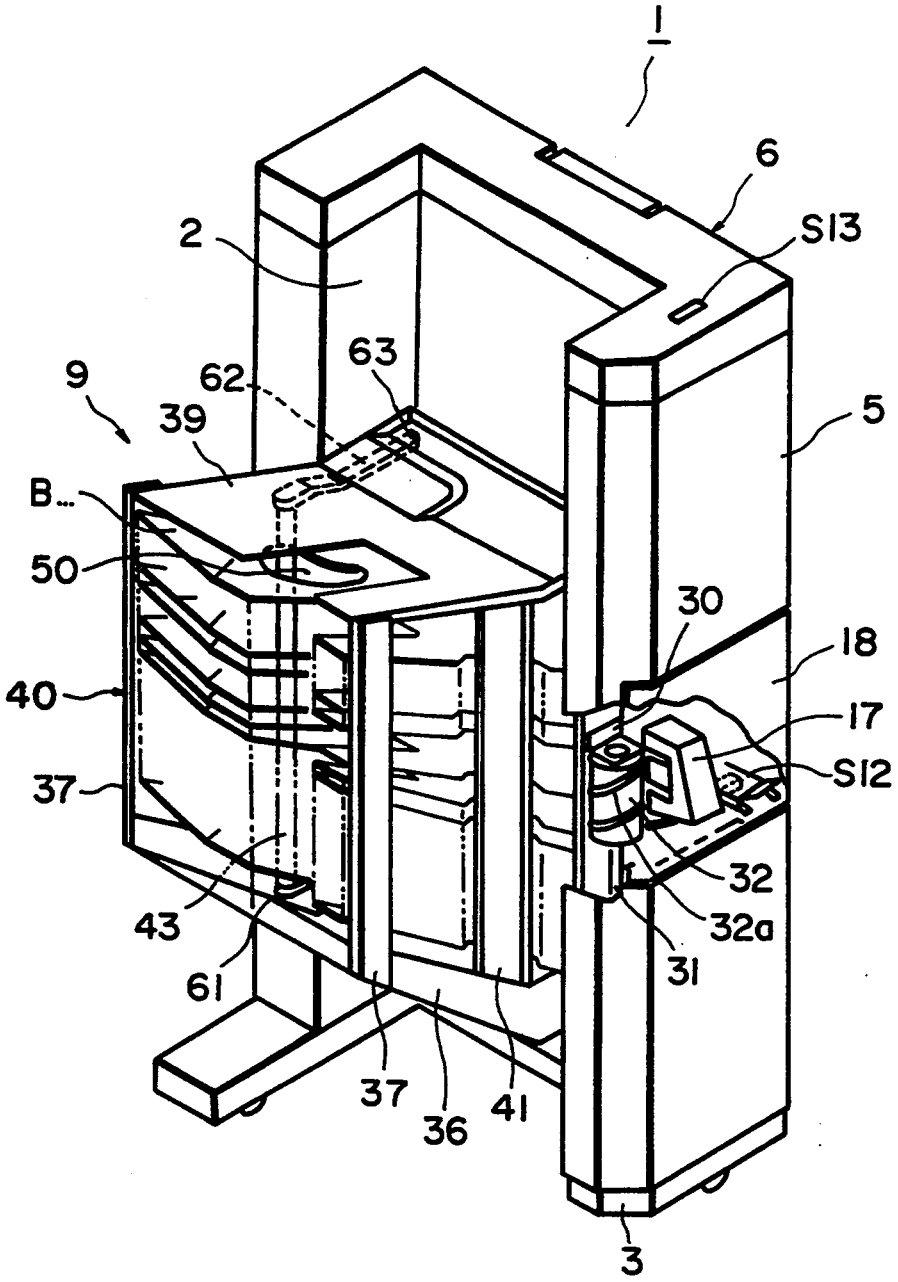
FIG. 2 is a perspective view of FIG. 1 apparatus.

Referring to FIGS. 1 and 2, a sorter 1 according to an embodiment of the present invention is provided with a main assembly 6 having front and rear side plates 2, a base 3 and a cover 5 and a bin unit 9 having a number of bins B and vertically movable.

The main assembly 6 is provided with a pair of inlet rollers 11 adjacent a sheet inlet 10 for receiving the sheets discharged from an image forming apparatus such as a copying machine. Downstream of the pair of inlet rollers 11 with respect to movement direction of the sheet, there are provided a non-sort passage 12 and a sort passage 13 branched out of the non-sort passage 12. The non-sort passage 12 extends substantially horizontally to a pair of rollers for discharging non-sorted sheets, which constitute a non-sorted sheet outlet. The sort passage 13 extends downwardly to a pair of rollers 16 for discharging sorted sheets, which constitute a sorted sheet outlet. Faced to the sheet discharging roller pair 16, a stapler 17 is disposed.

The cover 5 is provided with a stapler door 18 and a door switch S12 at a position opposing to the stapler 17. When, for example, the staples are to be exchanged in the stapler 17, the stapler door 18 is opened and/or closed, and the closing and opening of the stapler door 18 are detected by the door switch S12.

On the top of the cover 5, a non-sorted sheet stapling button S13 is disposed, which is depressed when a stapling non-sort mode is selected wherein the sheets P are not sorted but stapled.

Adjacent to the inlet roller pair 11, there are a flapper 19 for switching the sheet conveyance direction and a flapper solenoid 20 for driving the flapper 19. When the flapper solenoid is actuated, the flapper 19 is displaced to switch the sheet conveying direction to the non-sorted sheet discharge outlet 15 side; and when the flapper solenoid 20 is deactuated, the sheet conveyance direction is switched to the sorted sheet discharge outlet 16 side. Adjacent to the inlet roller pair 19, there is also provided a conveying motor 21 which drives the inlet roller pair 11, the non-sorted sheet discharging roller pair 16 and the sorted sheet discharging roller couple 16.

A non-sorted sheet passage sensor S1 is disposed in the non-sorted sheet passage 12; and a sorted sheet passage sensor S2 is disposed in the sorted sheet passage 13. The conveying motor 21 is provided with a clock sensor S11 for detecting rotation of the conveying motor 21.

Downstream of the non-sorted sheet discharging rollers 15 and the sorted sheet discharging rollers 16, a bin unit 9 is disposed which is substantially vertically movably supported with its weight is balanced by a spring force provided by a spring 23 having an end fixed to the main assembly 6 and the other end engaged with a hook 22 of the bin unit 9. At the inlet side of the bin unit 9, an upper guiding roller 25 and a lower guiding roller 26 are rotatably supported at the upper and lower portions, respectively. The upper and lower guiding rollers 25 and 26 are engaged with a guiding plate 26 mounted on the main assembly 6 and extending substantially vertically, so that when the bin unit 9 moves vertically, they roll in the guiding plate 27 to guide the bin unit. A bin unit driving motor 29 is mounted on the main assembly or frame 6. Adjacent to the sorted sheet discharging rollers 16 of the main assembly 6, there is a cam shaft holder 30, and a lead cam shaft 31 is rotatably supported between the cam shaft holder 30 and a thrust bearing 34 on the base 3. Above the lead cam shaft 31, there is a lead cam 32, and below the lead cam shaft 31, a sprocket 33 is fixed. Between the sprocket 33 and the bin unit driving motor 29, a chain 35 is stretched, so that the lead cam 32 is rotatable in forward and backward directions by the bin unit driving motor 29 which is reversible upon selection.

Figure 3:
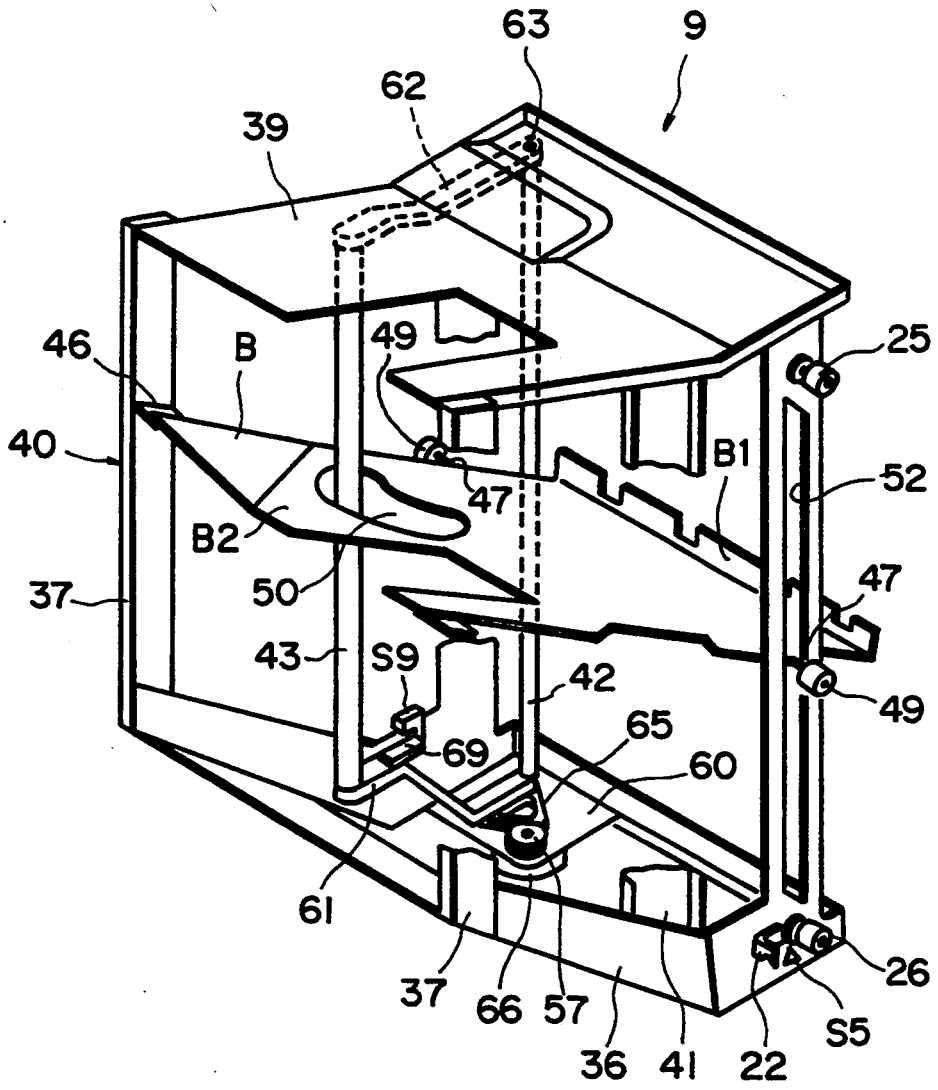
FIG. 3 is a perspective view of a bin unit.

As shown in FIGS. 1–3, the bin unit 9 comprises a bin unit main assembly 40 including a frame 36 having an inclined portion, a vertical portion and a horizontal portion, vertical frames 37 and 37 extending vertically at the front and rear side of the inclined portion of the frame 36 and a bin cover 39 supported on the vertical frames 37 and 37. At the front side of the bin unit main assembly 40, there is disposed an alignment reference plate 41 for abutment by the sheets. The bin unit 9 includes a number of bins B, and is provided with an alignment rod 43 movable about a central shaft 42.

Figure 4:
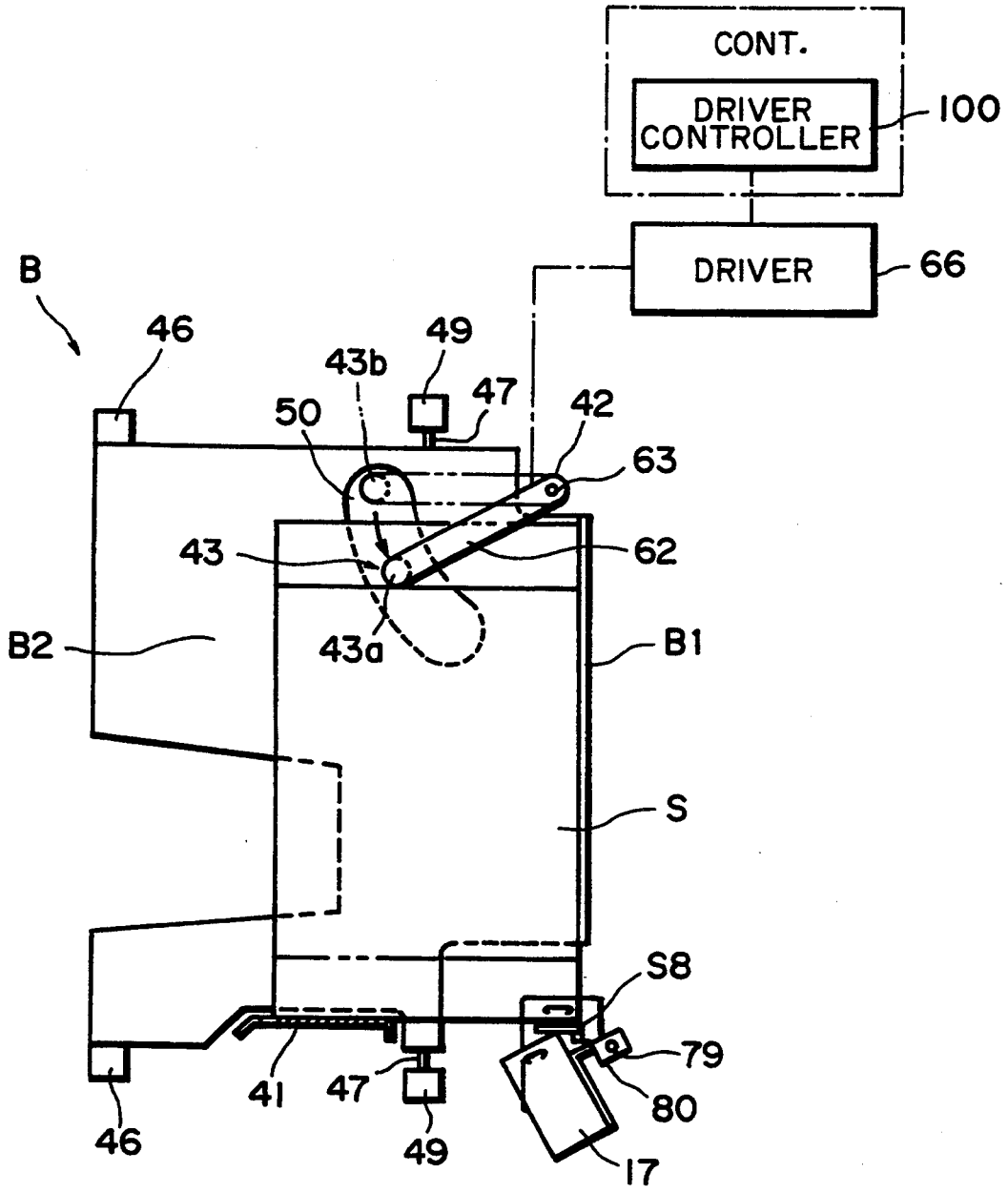
FIG. 4 is a top plan view of a bin.

As shown in FIG. 4, the bin B has engagement plates 46 formed at the front and rear portions at the outlet side. The engagement plates 46 are engaged with an unshown supporting plate provided at an inner side of the vertical frames 37, whereby the inlet side of the bin B is supported. On front and rear portions of the bin B at the inlet side, roller supporting pins 47 are fixed, to the pins 47 bin rollers 49 are rotatably supported. The bin B has an elongated slot 50 which is circular to be away from the central shaft 42 by a predetermined distance. The slot 50 has a length longer than the movable range of the alignment rod 43 and has a width sufficiently larger than the width or a diameter of the alignment rod 43. As seen in FIG. 3, the inlet side B1 of the bin B rises substantially vertically from a sheet receiving or accommodating surface B2. As shown in FIGS. 1–3, the bin B is generally inclined at a predetermined angle relative to the main assembly 6, upwardly away from the inlet side, whereby the sheet received thereby slides on the sheet accommodating surface B2, so that the trailing edge of the sheet is abutted to the vertical portion B1, whereby the sheet is aligned in the sheet movement direction.

The bin roller 49 of the bin B penetrates through an elongated slot 52 formed at the inlet side of the bin unit main assembly 40 to be engaged with the guiding plate 27 of the main assembly 6. The bin roller **49*n* of the bottommost bin Bn is supported on the lower guiding roller 26. Similarly, the bin roller 49*e* of the bottommost but one bin Be is supported on the bin roller 49*n* of the bottommost bin Bn. In the same manner, the bin roller 49 of each one of the bins B is supported on the bin roller 49 of the immediately lower bin B. Thus, the inlet sides of the bin B are supported on the bin unit main assembly 40**.

Figure 5:
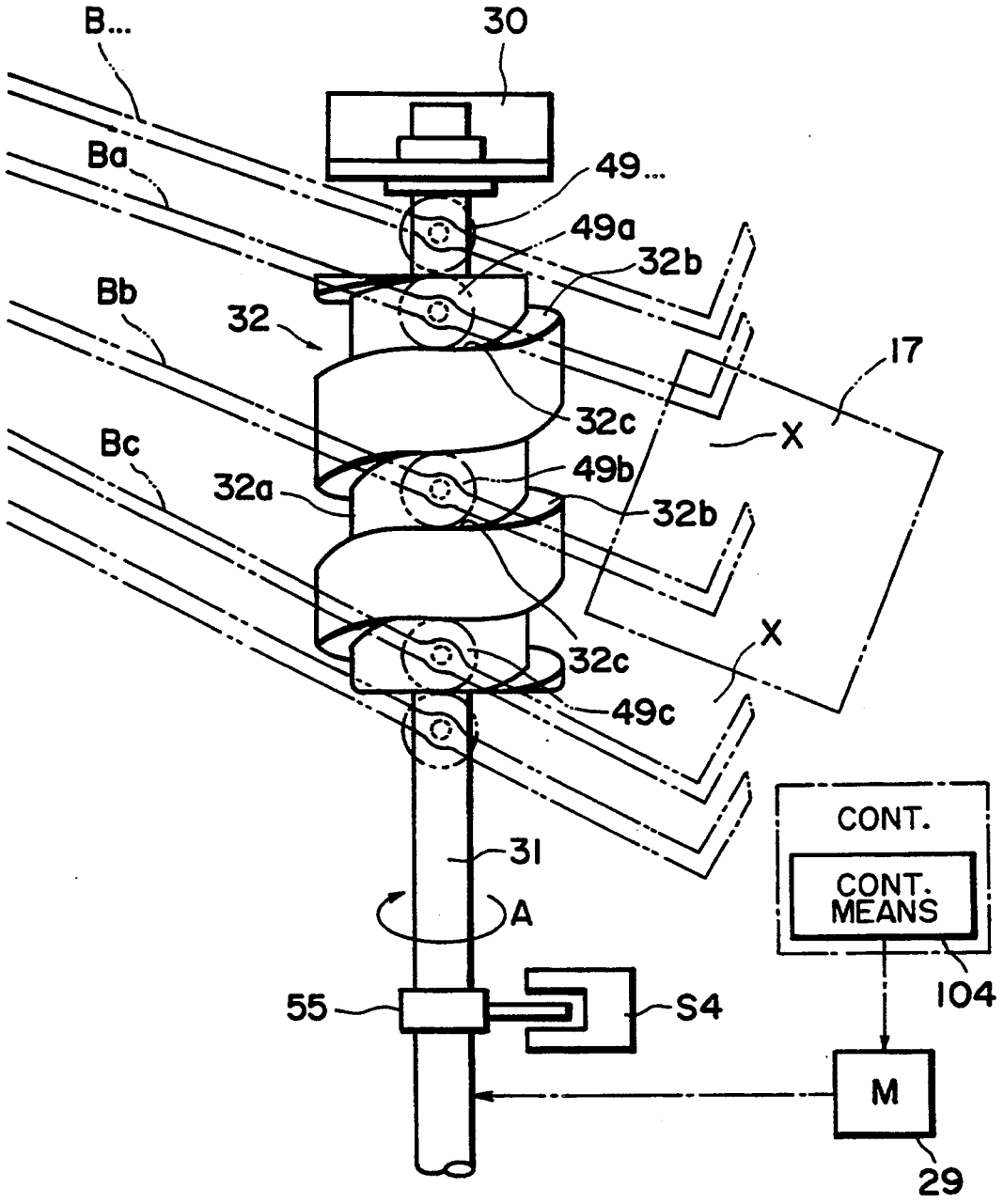
FIG. 5 is a side view of a lead cam.
Figure 6:
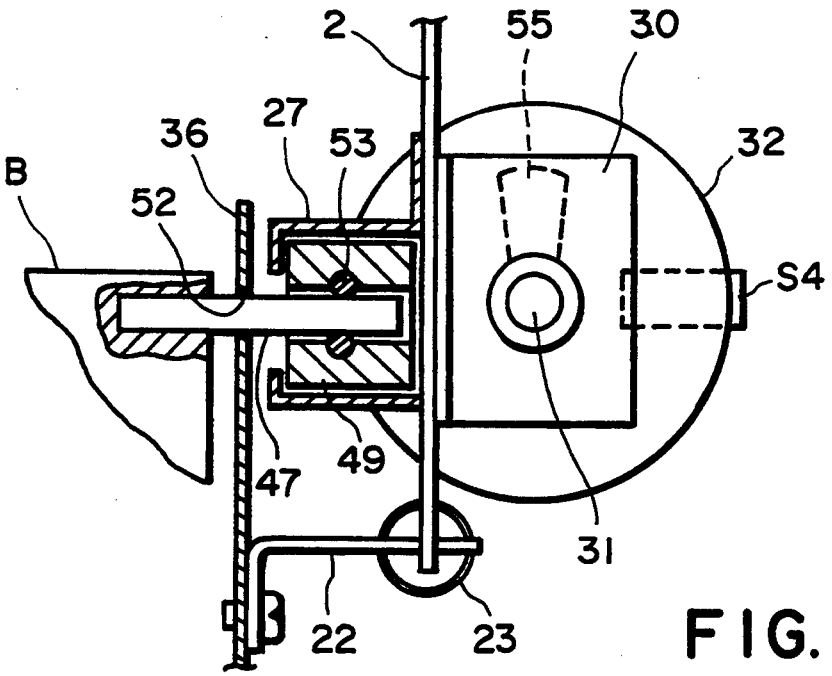
FIG. 6 is a top plan view of the lead cam.

As shown in FIGS. 5 and 6, the lead cam 32 has a helical cam groove **32*a* having a width slightly larger than the diameter of the bin roller 49. The lead cam 32, when it is rotated, receives by the cam groove 32*a* the bin roller 49 of the bin B which is currently faced to the sorted sheet discharging rollers 16**.

As shown in FIG. 5, for example, by one full turn of the lead cam 32 in the direction A, the bin roller **49*c* of the bin Bc is moved to an intermediate position 49*b* of the lead cam 32, and by a further one full turn, it is moved to the position 49*a* passing through the lead cam 32. When the lead cam 32 is further rotated by one full turn, the bin roller 49*a* at the lead cam 32 passing position pushes up the upper bin roller 49**.

As shown in FIG. 2, the upper bin roller 49 pushes up the further upper bin roller 49, whereby the topmost bin roller 49 pushes up the upper guiding roller 25. Thus, the bin unit 9 is moved upwardly step by step. By the movement of the bin roller 49, the bins B are sequentially moved. During the movement, as shown in FIGS. 2 and 5, for example, at the position faced to the sorted sheet discharging rollers 16, wider access spaces X and X are formed between the bin Bb for receiving the sheet from the sorted sheet discharging rollers 16 and the upper bin Ba above it and between the bin Bb and the bin Bc below the bin Bb, than between the other adjacent bins. This manner, the rotation of the lead cam 32 moves the bin unit 9 upwardly and downwardly. A bin home position sensor S5 is disposed adjacent the hook 22 to detect the bin unit 9 moved to the bottommost home position.

The helical cam groove **32*a* of the lead cam 32 includes an inclined portion 32*b* and a parallel portion 32*c*. During the rotation of the lead cam 32, the inclined portion 32*b* moves upwardly or downward the bin roller 49 engaged with the cam slot 32*a*, whereas the parallel portion 32*c* does not move the bin roller 49**.

As shown in FIGS. 5 and 6, the lead cam shaft 31 has a flag 55, to which a lead cam sensor S4 is faced. By the detection of the flag 55 by the lead cam sensor F4, one rotation of the lead cam 32 is detected, and also the stop position of the lead cam 32 is detected.

Referring back to FIG. 1, transparent type sheet sensors S3 and S3 for detecting the sheet in the bins are disposed upper and lower position of the inlet side of the bin unit 9. When all the sheets P are taken out of the bin unit 9, the sensors S3 and S3 detect absence of the sheet, so that the end of one sequential operation is discriminated.

As shown in FIG. 6, an O ring 53 is fitted into the bin rollers 49 to absorb vibration of the bin B during upward and downward movements.

Referring to FIGS. 3 and 4, the alignment of the sheets P by the alignment rod 49 provided in the bin unit 9, will be described. A supporting plate 60 is disposed at the inlet and rear side of the frame 36 of the bin unit 9. On the supporting plate 60, a lower arm 61 is mounted. An end of the lower arm 61 is rotatably supported on a lower shaft (not shown) projected upwardly from the supporting plate 60. Also, to the end of the lower arm 61, a lower portion of the central shaft 42 is fixed coaxially with the above-mentioned lower shaft. To the other end of the lower arm 61, a lower portion of the alignment rod 63 is fixed. The upper portion of the alignment rod 43 and the upper portion of the central shaft 42 are fixed to an upper arm 62. The alignment rod 43 and the central shaft 42 are connected by the upper arm 62 and the lower arm 61. The central shaft 42 is rotatably supported on an upper shaft 63 projected downwardly from the bin cover 39. In this manner, the alignment rod 43 is movable about the central shaft 42. A sector gear 65 is fixedly secured to the lower arm 61, the sector gear 65 having a rotational center coincident with the center of the lower arm 61 movement. Below the supporting plate 60, there is an alignment rod driving motor 66. An output gear 67 of the alignment rod driving motor 66 is meshed with the sector gear 65, so that the alignment rod 43 is moved by the motor 66.

When the sheets P are aligned, the alignment rod 43 is moved from an unshown home position to an alignment position **43*a* predetermined corresponding to the sizes of the sheets P, so as to abut edges of the sheets P to align the sheets P by cooperation with an alignment reference plate 41. Thereafter, it is moved back to a stand-by position 43*b*** to be prepared for the next sheet alignment operation.

The alignment rod driving motor 66 is of a stepping motor type, so that the amount of movement of the alignment rod 43 is determined by the number of pulses supplied thereto.

A light blocking plate 69 is fixed to the lower arm 61. Since the light blocking plate 69 moves together with the lower arm 61, the alignment rod home position sensor S9 fixed on the frame 36 is rendered on and off.

Now, the stapler 17 disposed adjacent to the sorted sheet discharging rollers 16 will be described.

Figure 7:
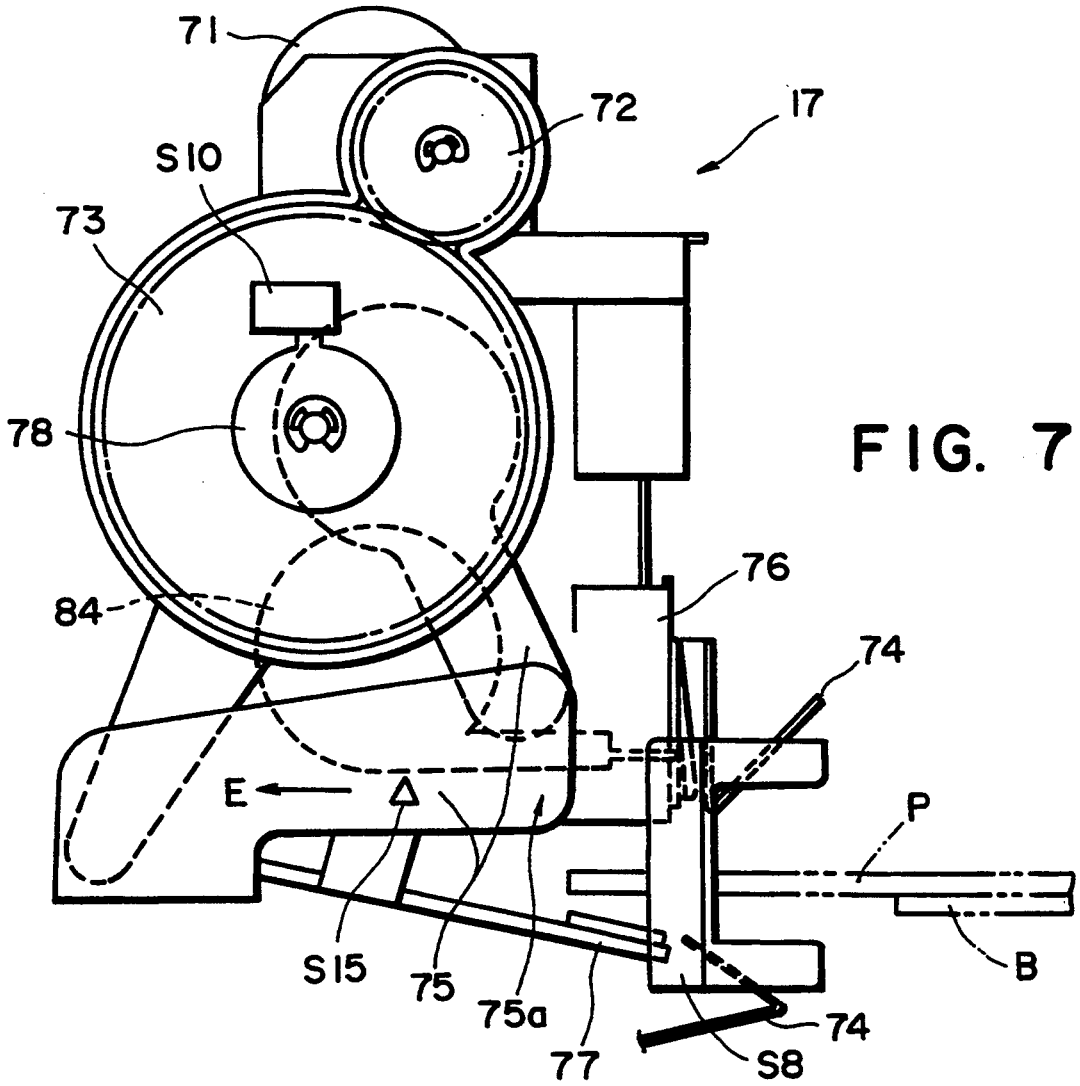
FIG. 7 is a side view of a stapler.
Figure 8:
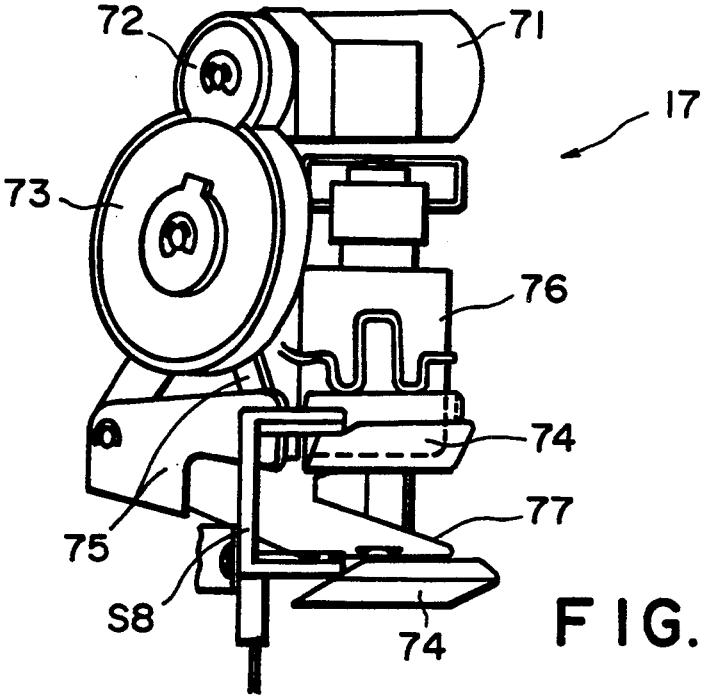
FIG. 8 is a perspective of the stapler.

As shown in FIGS. 7 and 8, the stapler 17 comprises a stapler motor 71 and a gear 72 fixed to an output shaft of the stapler motor 71. The gear 72 is meshed with a gear 73. To the gear 73 a link 75 is connected, and an end of the link 75 is fixed to the main assembly. A stapling head 76 is disposed adjacent to the articulation of the link 75. Below the head 76, an anvil 77 for bending the staple is disposed. The head 76 and the anvil 77 are provided with an upper and lower guides 74 and 74. The upper and lower guides 74 and 74 have end openings. The gear 73 is provided with a one rotation cam 78, to which a stapler cam sensor S10 is faced. The stapler cam sensor S10 serves to detect the stapling operation of the stapler 17 for each operation.

The stapler 17 is provided with a staple cartridge 84 which accommodates an integral set of numerous staples. The stapler cartridge 84 is mounted into and dismounted from the stapler 17 at its rear side. When the staples are to be replenished, the cartridge is retracted out of the stapler 17 in the direction E.

The stapler 17 is provided with a stapler moving station 88 for driving the stapler 17 between a staple operating position 17*a* and a retracted position 17*b*.

Figure 9:
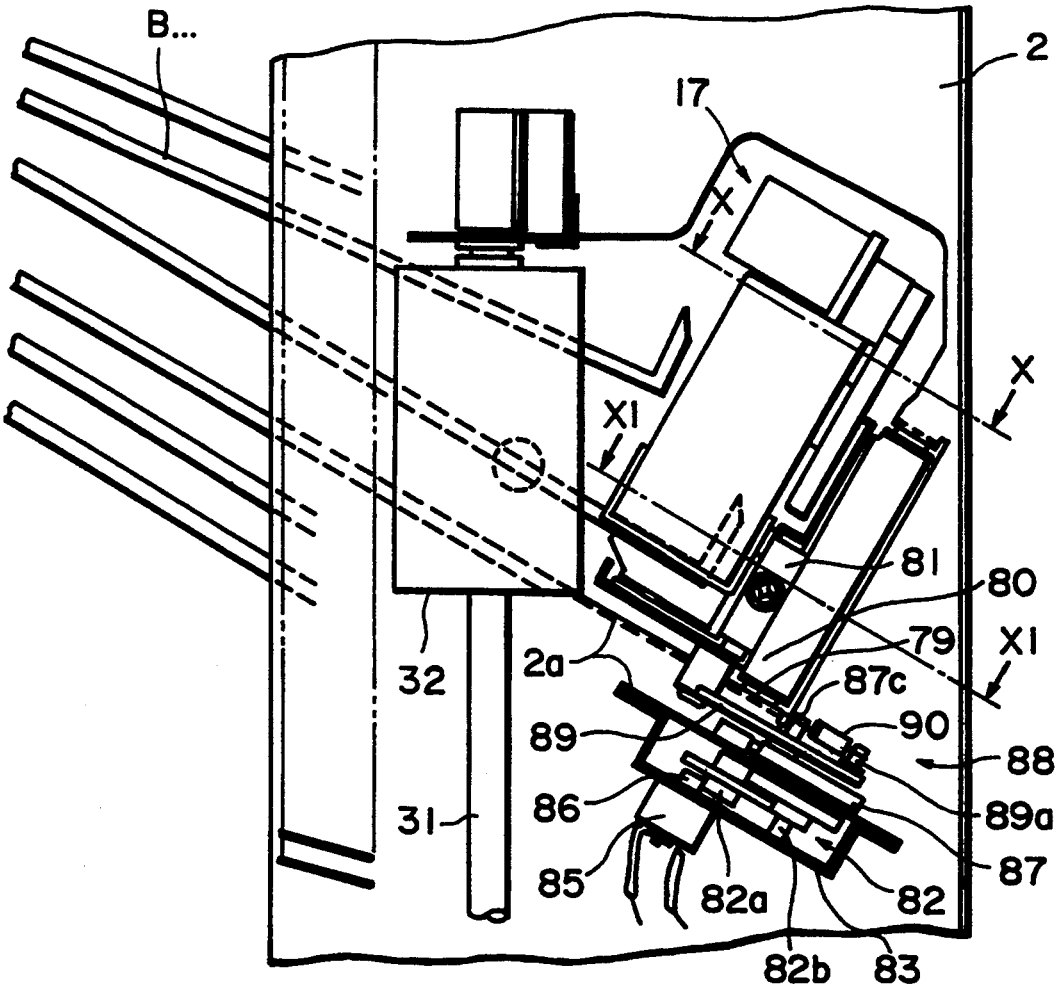
FIG. 9 is a side view of a stapler moving portion.
Figure 11:
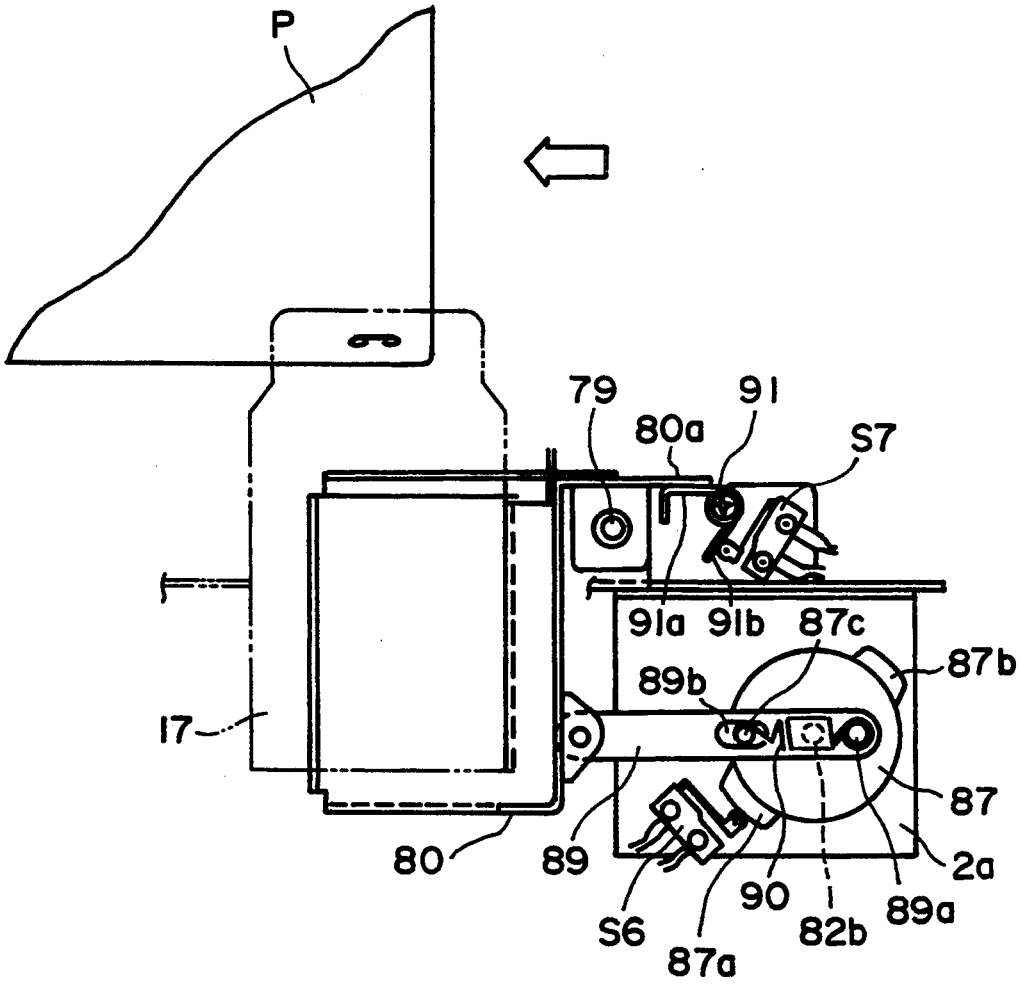
FIG. 11 is a sectional view taken along a line XI—XI of FIG. 9.

As shown in FIGS. 9 and 11, the stapler moving station 88 has a shaft 79 projecting out of the main assembly frame 2*a*, and by the shaft 79 the swingable base 80 is swingably supported. The swingable base 88 has a stapler base 81 fixed thereto. The stapler base 81 carries the stapler 17. The frame 2*a* has a gear box 83 containing therein a groove of reduction gears. In the gear box 83, a stapler swinging motor 85 is disposed. A gear 86 is fixed to an output shaft of the stapler swinging motor 85 and is meshed with an input gear 82*a* of the reduction gear tray 82. A link disk 87 is fixed to an output gear 82*b* of the reduction gear train 82. To the outer periphery of the link disk 87, cam portions 87*a* and 87*b* are faced each other. The cam portions 87*a* and 87*b* are effective to actuate and deactuate a stapler positioning sensor S6 disposed on the frame 2*a* to actuate the stapler swinging motor 85. Adjacent the outer periphery of the link disk 87, a pin 87*c* is projected. A link arm 89 is extended substantially horizontally and rotatably connected to the swingable base 80. From the link arm 89 a bin 89*a* is projected, and the link arm 89 has an elongated slot 89*b* formed therein. The pin 87*c* is engaged into the elongated slot 89*b*, and a spring 90 is stretched between the pins 87*c* and 89*a*. Adjacent to the shaft 79, a sensor actuating arm 89 made of a plastic resin or the like is rotatably supported, and one end 91*a* of the sensor actuating arm 91 is contacted to an end 80*a* of the swingable base 80. The other end 91*b* thereof is contacted to the stapler operating position sensor S7.

Figure 10:
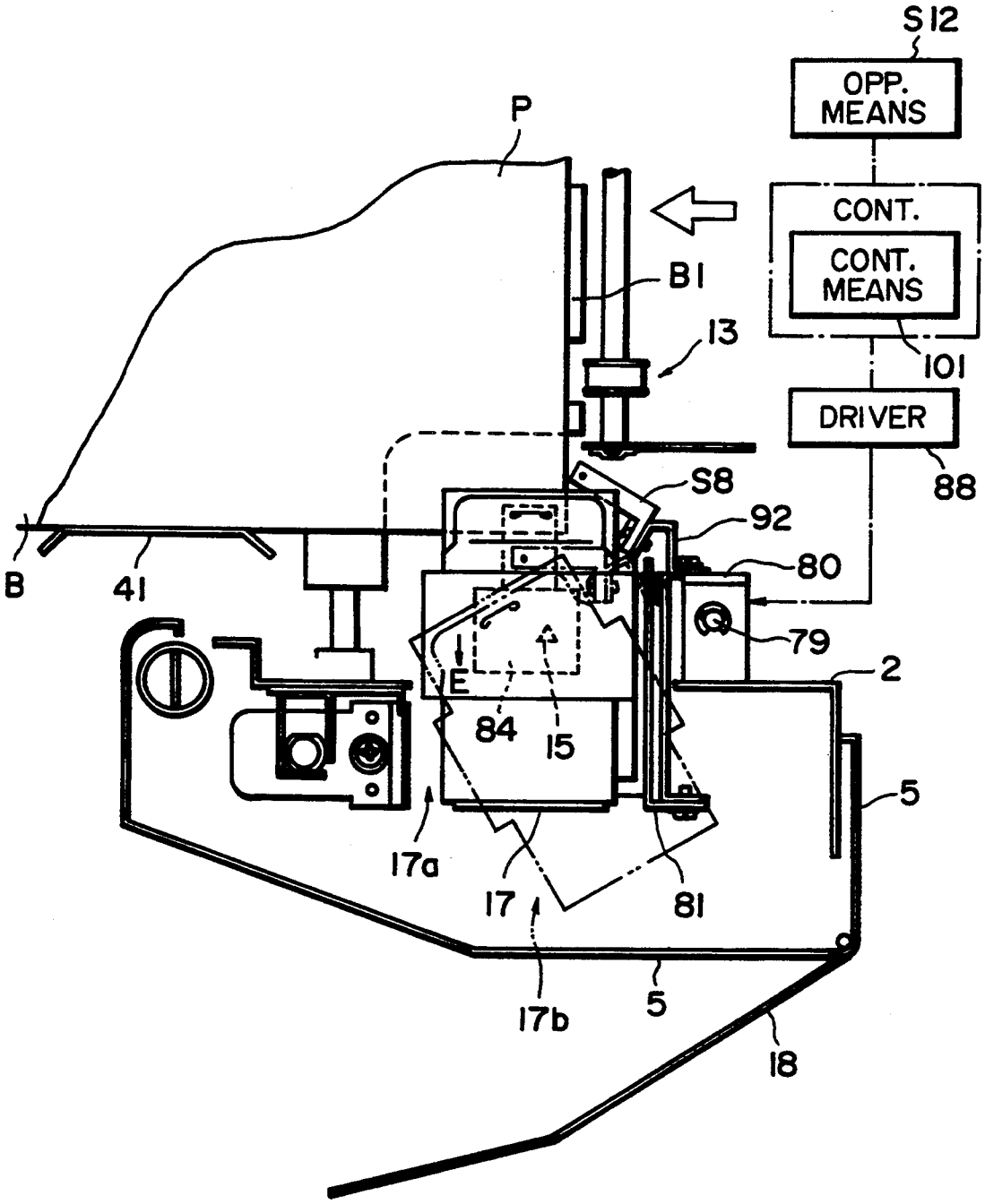
FIG. 10 is a sectional view taken along a line X—X.

As shown in FIG. 10, the swingable base 80 has a stapler sheet sensor S8 supported by a mounting base 92. The sensor S8 is a transparent type having a channel-like cross-section and constituted by a light emitting portion and a light receiving portion (FIG. 8).

When the sheets P are to be stapled, the stapler 17 is moved by the stapler moving station 88 to a stapling position 17*a* within the bin moving range. After the stapling, it is retracted to the retracted position 17*b* which permits movement of the bin B, and the stapler 17 is maintained at the retracted position 17*b* waiting for the next operation.

Figure 12:
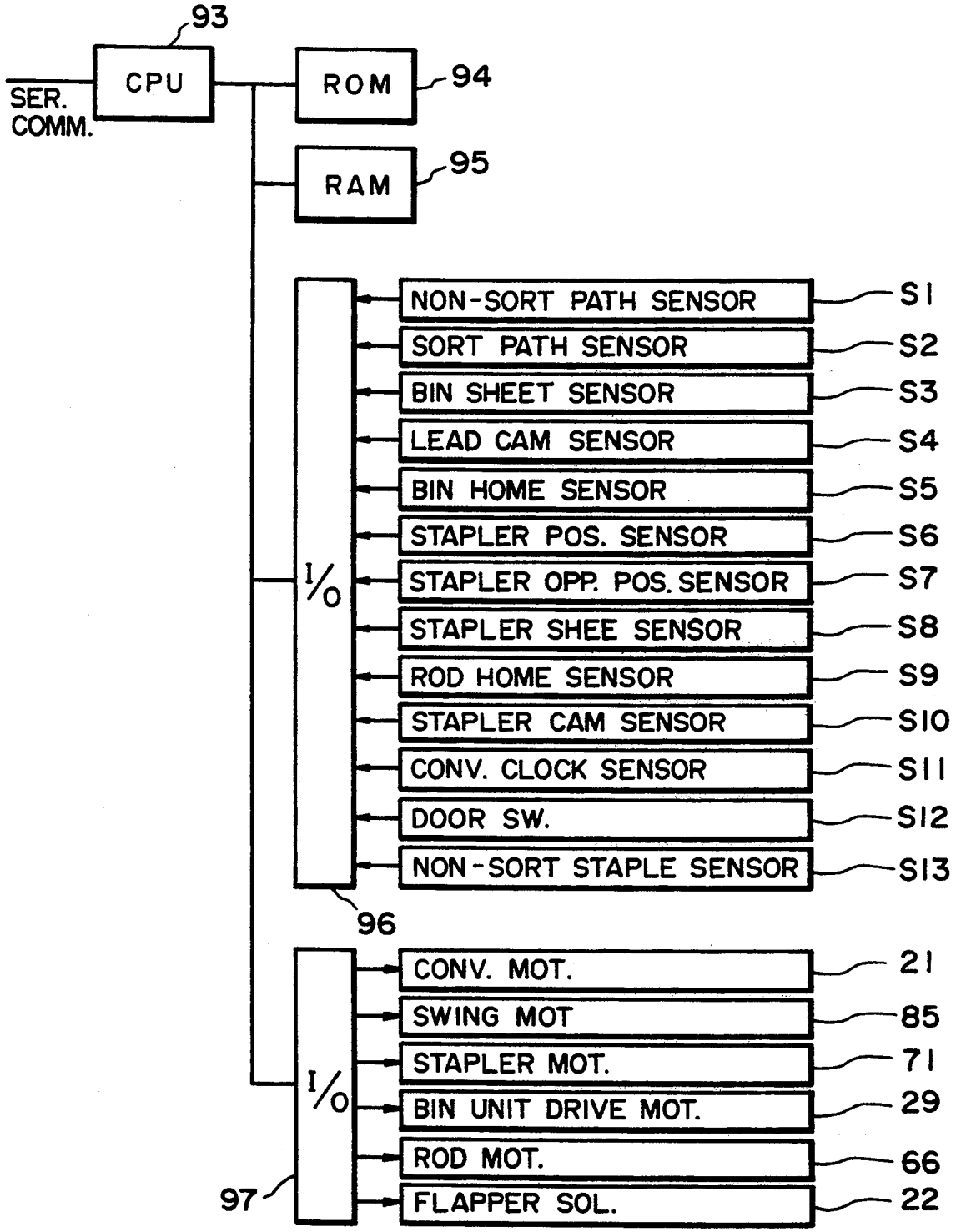
FIG. 12 shows a control system.

As shown in FIG. 12, the sorter 1 is provided with a control device including a central processing unit (CPU) 93, a read only memory (ROM) 94, a random access memory (RAM) 95, an inlet port 96, an outlet portion 97 and other elements. The ROM 94 has a control program stored therein, and the RAM 95 stores input data and operational data. To the import 96, various sensors and switches such as the non-sorted passage sensor S1 or the like are connected, and to the output port 97, various loads such as the conveying motor 21 or the like are connected. The CPU 93 controls through a base line the various loads in accordance with the control program stored in the ROM 94. The CPU 93 is provided with a serial interface to effect serious communication with a CPU of the main assembly of the copying machine, for example, to control various parts in accordance with the signals from the main assembly of the copying apparatus.

The control device includes a control means 103 having a program for discharging the sheets P to a bin B with which the sheets P can be stapled, so as to allow the sheets P to be stapled even in the non-sort mode wherein the sheets P are not sorted. When the stapling and non-sorting mode wherein the non-sorted sheets are stapled is selected by depressing the non-sorted sheet stapling button S13, the control means 103 deenergize the flapper solenoid 20 in response to the signal from the button S13 to displace the flapper 19 to allow the sheets P to be discharged from the sorted sheet discharging outlet 16. Then, the sheets P are guided by the flapper 19 and are discharged through the sorted sheet discharging outlet 16 onto the bin B with which the sheets P can be stapled. Subsequently, the sheets P are stapled on the bin B. In this manner, the non-sorted sheets which conventionally have not been stapled can now be stapled.

Figure 13:
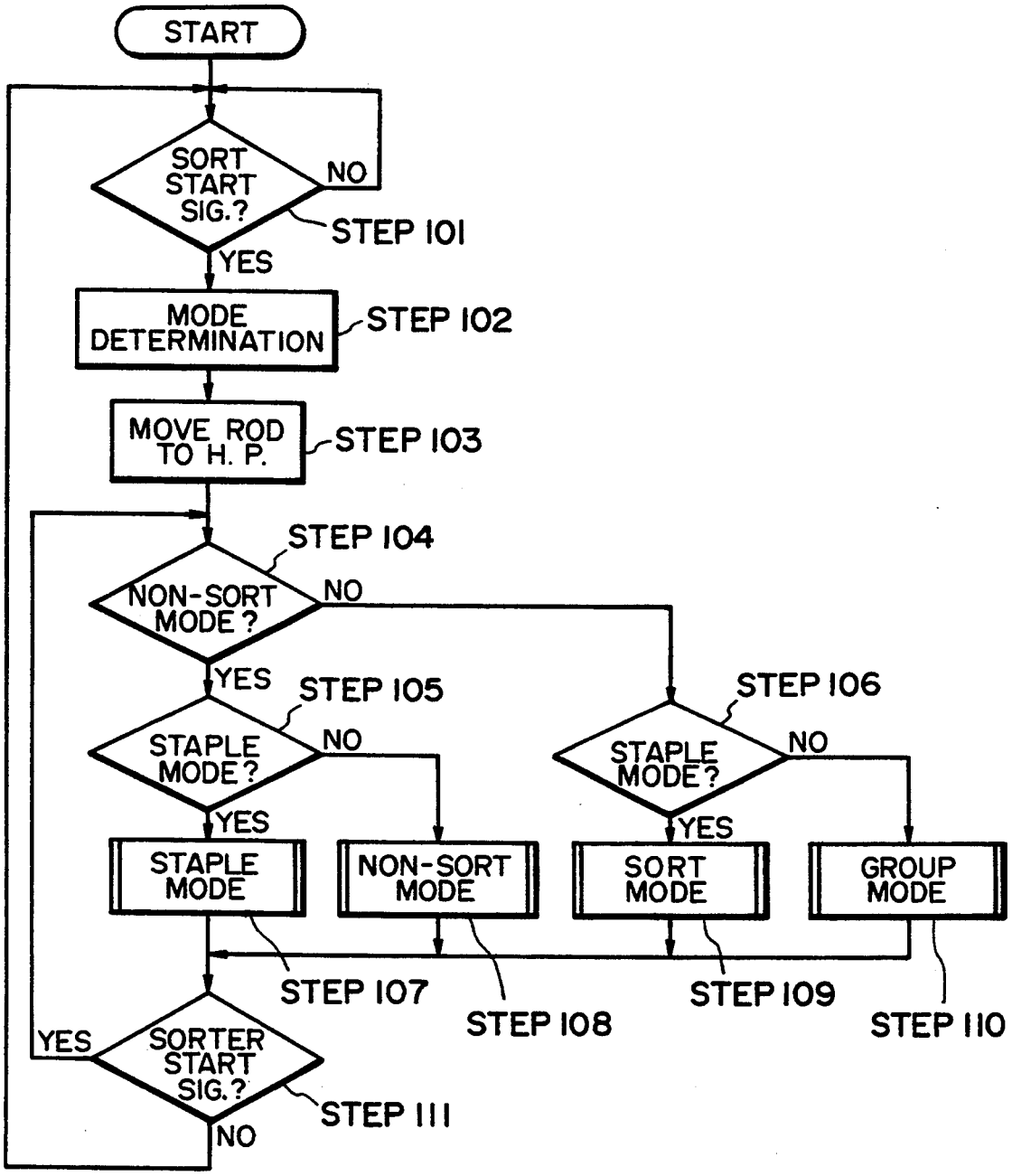
FIGS. 13–19 are flow charts illustrating operation of the sorter according to the embodiment of the present invention.

Referring to FIGS. 13–19, operation of the apparatus according to this embodiment will be described. As shown in FIG. 13, when the copying operation is started by actuation of the copy start key of the main assembly of the copying apparatus, for example, a sorter starting signal is supplied to the sorter from the main assembly of the copying machine by the serial communication. The sorter 1 is waiting for the signal at step 101, and the sequence proceeds to step 102 when the sorter start signal is supplied thereto. In the step 102, an operating mode is determined during one job until the sorter start signal is shut off, and the mode data corresponding to the determined mode is stored in the RAM 95. At step 103, the alignment rod 43 is once returned to its home position in order to detect the position of the alignment rode 43. In the step 102, various parts are operated in accordance with the determined mode. At step 104, the discrimination is made as to whether the selected mode is the non-sorting mode or not. If so, the discrimination is made as to whether or not the sheets are to be stapled at step 105. If so, the sequence proceeds to the stapling and non-sorting mode (step 107). If not, the sequence goes to the non-sorting mode (step 108).

Referring back to the step 104, if the non-sorting mode is discriminated, the sequence goes to step 106 wherein the discrimination is made as to whether or not it is the sorting mode. If so, the sequence proceeds to the sorting mode (step 109). If not, the grouping mode is discriminated, and the sequence proceeds to the step 110. After completion of the operations in one of the above modes, the programmed sequence proceeds to the step 111 where the discrimination is made as to whether or not the sorter starting signal produced, that is, whether or not one job is completed. If so, the one job is not deemed as having been completed, and the sequence goes back to the step 104. If not, the completion of the one job is discriminated, and the programmed sequence goes back to the first step 101.

Figure 14:
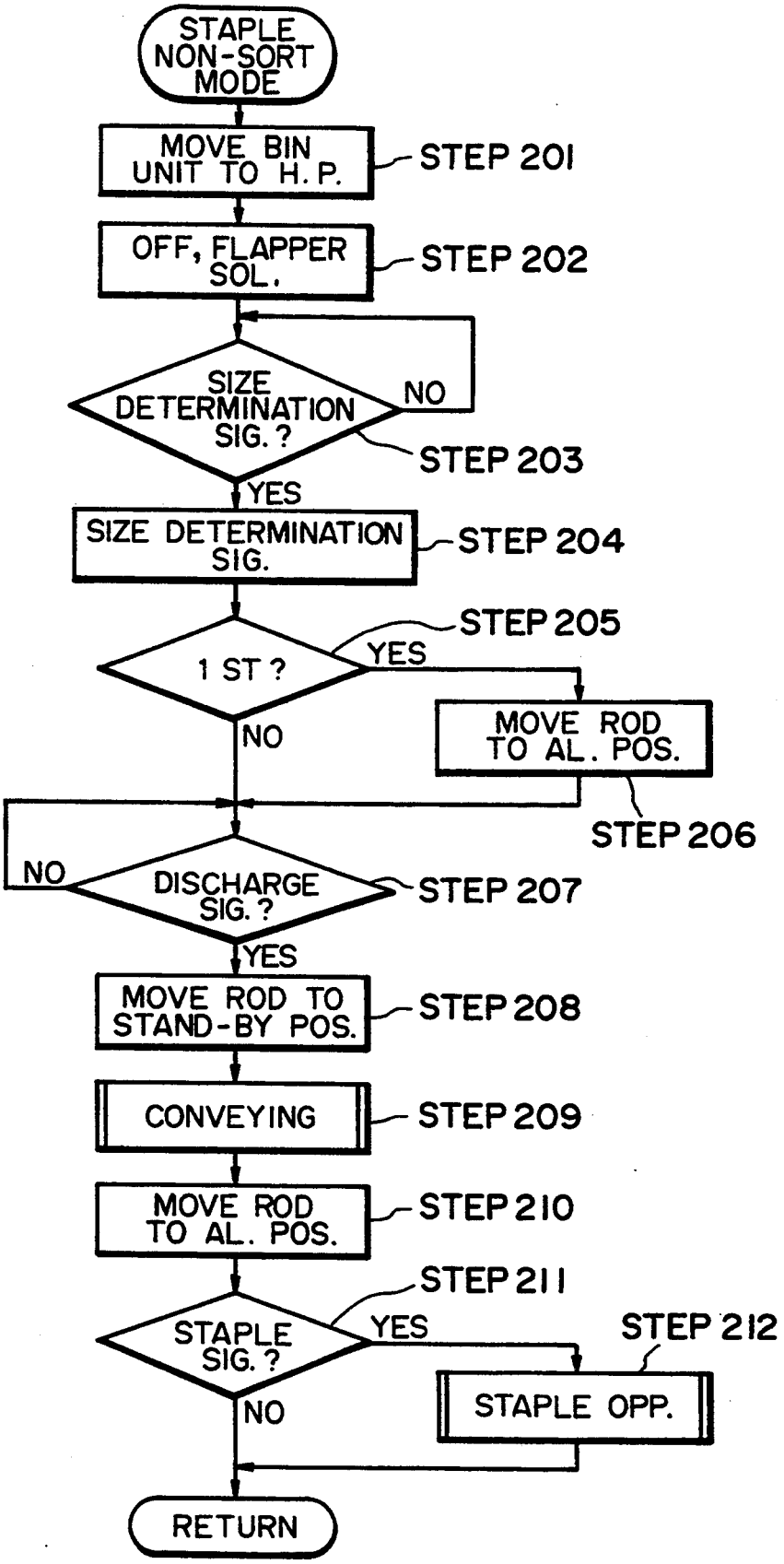

Referring to FIG. 14, the description will be made as to the stapling and non-sorting mode. The bin unit 9 is to be positioned at its home position in the stapling and non-sorting mode, and therefore, at step 201, the bin unit 9 is returned to the home position. However, the stapler 17 is unable to staple the sheets stacked on the bin cover 39 which receives the sheet when the bin unit 9 is situated at the home position, although the stapler 17 is able to staple the sheets accommodated in the bin B. Therefore, when the stapling mode is selected even in the non-sorting mode by depressing the non-sorted sheet stapling button S13, the sheets are discharged into the bin B. To accomplish this, the flapper solenoid 20 is deenergized to select the sorted sheet discharging outlet at step 202. Thereafter, it waits for the size determination signal in step 203. When the size determined signal is produced, the sequence goes to step 204 wherein the size data from the main assembly of the copying machine is stored in the RAM 95. If the sheet discharged from the main assembly of the copying machine is discriminate as being the first discharged sheet at step 205, the alignment rod 43 is to be located at the home position, and therefore, the alignment rod 43 is shifted to the alignment position 43*a* (step 206). If the discharged sheets is discriminated as not being the first sheets at step 205, or after the alignment rod 43 is moved to the alignment position 43*a* at step 206, the sequence proceeds to the step 207 wherein the sheet discharging signal from the main assembly of the copying machine is awaited. When the sheet discharging signal is produced, the alignment rod is moved from the alignment position 43*a* to the stand-by position 43*b* at step 208, and the sheet is conveyed into the bin B at step 209. The alignment rod 43 is moved to the aligning position 43*a* to align the sheet at step 201. The sequence proceeds to step 211 wherein the discrimination is made as to the stapling signal is produced or not. If so, the stapling operation is performed at step 211. If not, the sequential operation returns to the main routine.

Figure 15:
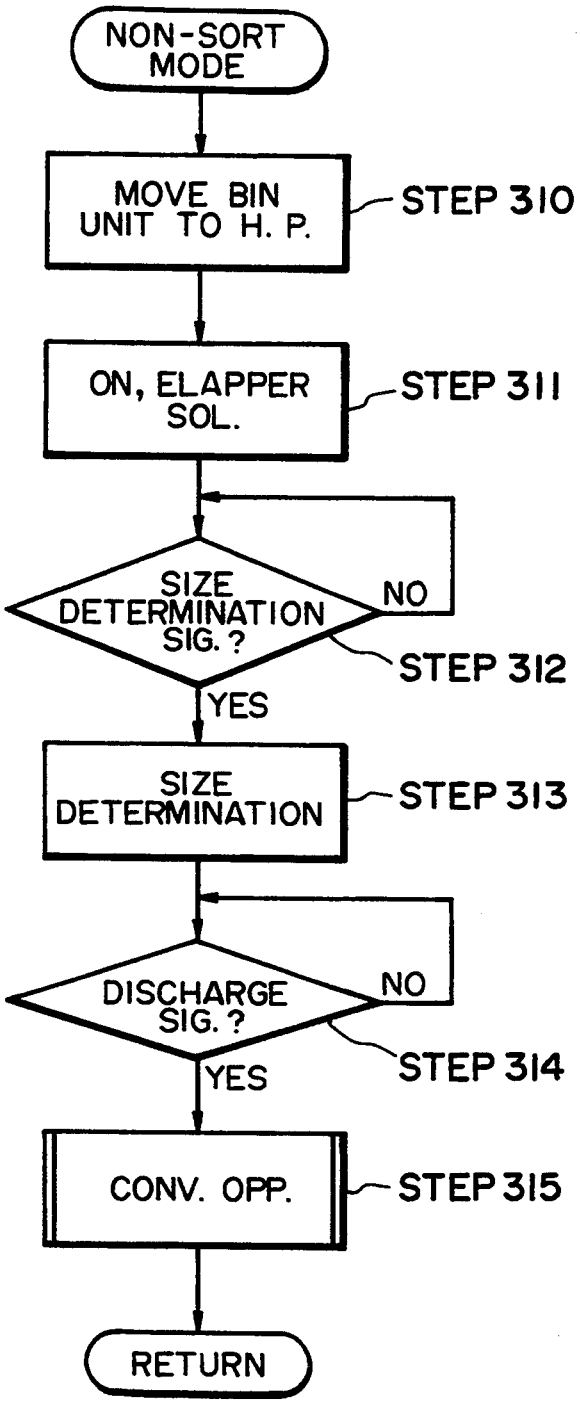

Referring to FIG. 15, the operation in the non-sorting mode will be described. In the non-sorting mode, the sheets are discharged onto the bin cover 39, and therefore, the bin unit 9 is moved to the home position (bottommost position) at step 310. In order to discharge the sheet through the non-sorted sheet discharging outlet 15, the flapper solenoid 20 is actuated at step 311. Thereafter, the size determination signal is awaited at step 312. When the size determination signal is produced, the size is determined at step 313. The sequence goes to the step 314 wherein the sheet discharging signal from the main assembly of the copying machine is awaited, and when the discharging signal is produced, the sequence proceeds to step 315 to discharge the sheet onto the bin cover 39. Thereafter, the programmed sequence returns to the main routine.

Figure 16:
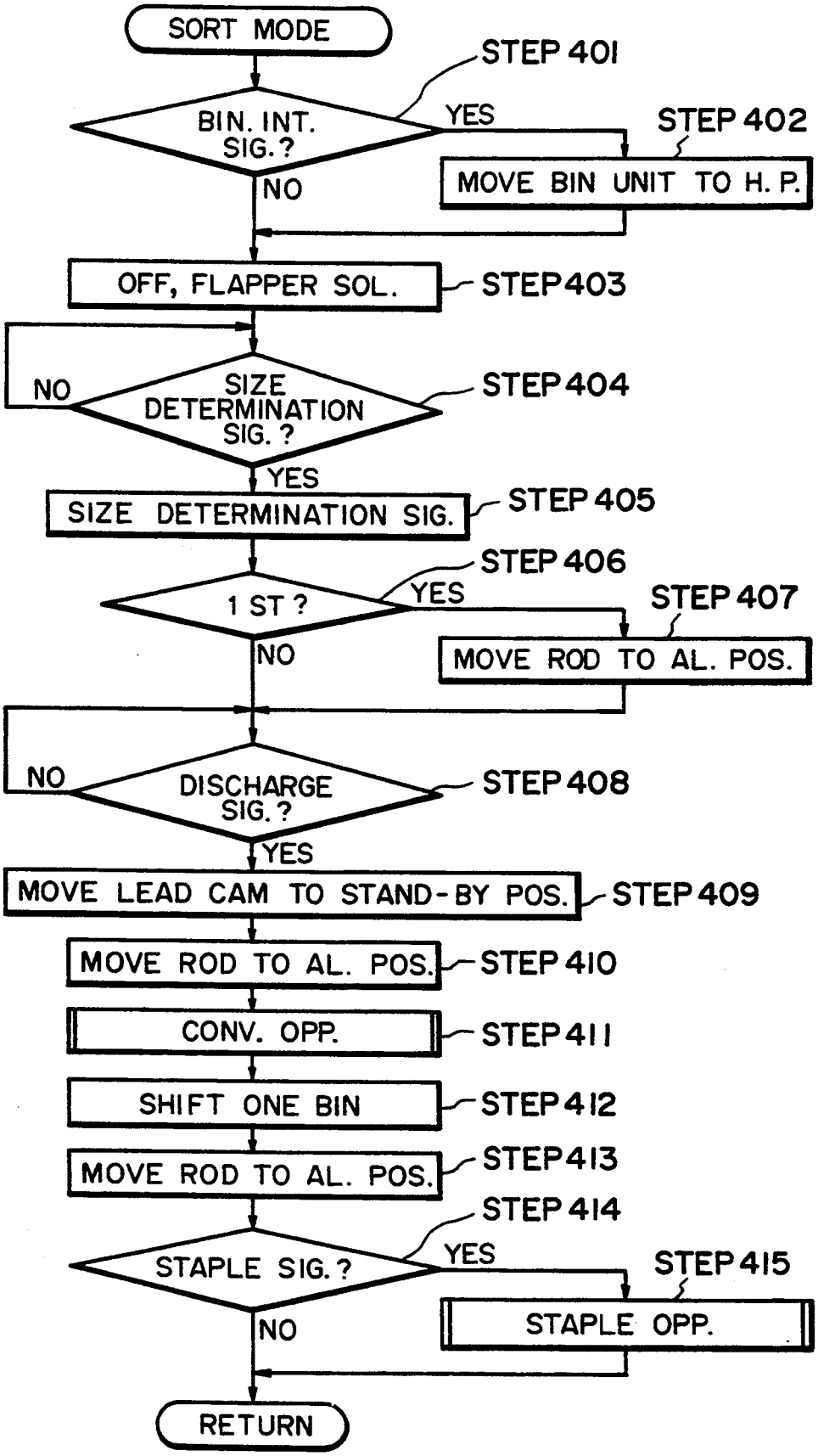

Referring to FIG. 16, the sorting mode operation will be described. In this mode, the discrimination is made at step 401 whether or not a bin initializing signal for returning the bin unit 9 to the home position is produced. Only when it is produced, the bin unit 9 is moved to the home position at step 402. Then, in order to select the sorted sheet discharging outlet 16, the flapper solenoid 20 is deenergized at step 403. The sequence goes to step 404 wherein the size determination signal is awaited. When the size determination signal is produced, the sequence advances to the step 405 wherein the size is determined. Then, the discrimination is made as to whether or not the size determination is for the first sheet at step 406. Only when it is for the first sheet, the alignment rod 43 is moved to the aligning position 43*a* at step 407, and the sequence proceeds to step 408 wherein the sheet discharging signal from the main assembly of the copying apparatus is awaited. When the discharging signal is produced, the sequence goes to 409 wherein the lead cam 32 is moved to its stand-by position, and thereafter, the alignment rod 43 is moved to its stand-by position 43*b* at step 410. Next, the conveying operation for discharging the sheets into the bins B at step 411. After completion of the conveying operation, the bin unit guiding motor 29 is actuated, and the bin is shifted by the amount of one bin at step 412, and the alignment rod 43 is moved to the aligning position 43*a* at step 413. Then, the sequence advances to step 414 wherein the discrimination is made as to whether or not the stapling signal is produced. Only when it is produced, the stapling operation is performed at step 415. Then, the sequence goes back to the main routine.

Figure 17:
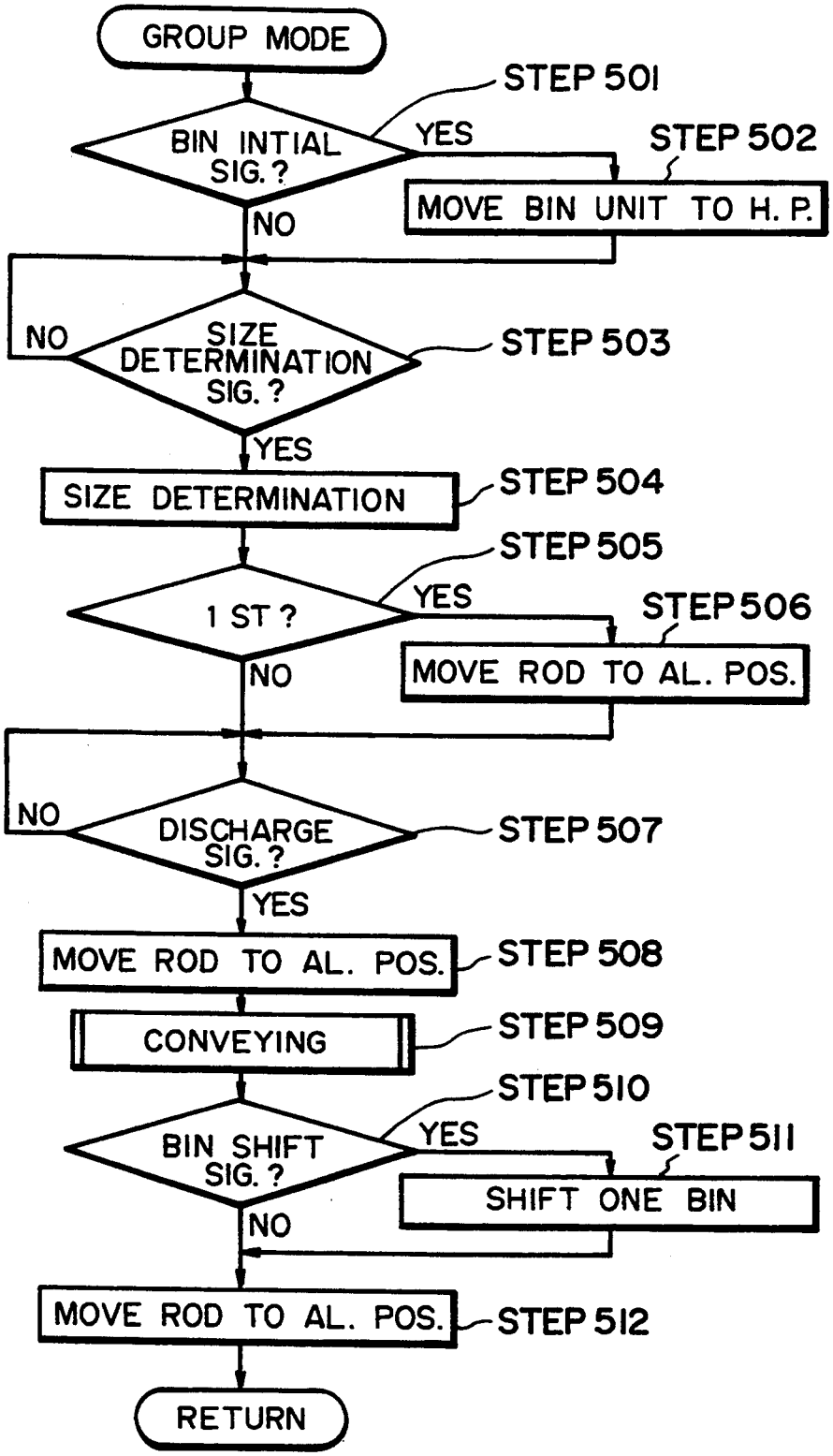

Referring to FIG. 17, the operation in the grouping mode will be described.

First, the discrimination is made at step 501 as to whether or not the bin initializing signal is produced from the main assembly of the copying machine. Only when it is produced, the bin unit 9 is moved to its home position at step 502. Then, the size determination signal is awaited at step 503. When the size determination signal is produced, the sequence goes to step 504 wherein the size is determined. Thereafter, at step 505, the discrimination is made as to whether or not the size determination is for the first sheet or not. If it is for the first sheet, the alignment rod 43 is moved to the aligning position 43*a* at step 506. Then, the sequence proceeds to step 507 wherein the sheet discharging signal is awaited. When the sheet discharging signal is produced, the sequence advances to step 508 wherein the alignment rod 43*a* is moved to the stand-by position 43*b*, and then, the conveying operation for conveying the sheet into the bin B is performed at step 509. After completion of the conveying operation, the sequence goes to step 510 wherein the discrimination is made as to whether or not the bin shift signal is produced from the main assembly of the copying machine. Only when it is produced, the bin is shifted by the amount of one bin at step 511. In order to align the sheet, the alignment rod 43 is moved to the aligning position 43*a* at step 511. Thereafter, the programmed sequence goes back to the main routine.

Figure 18:
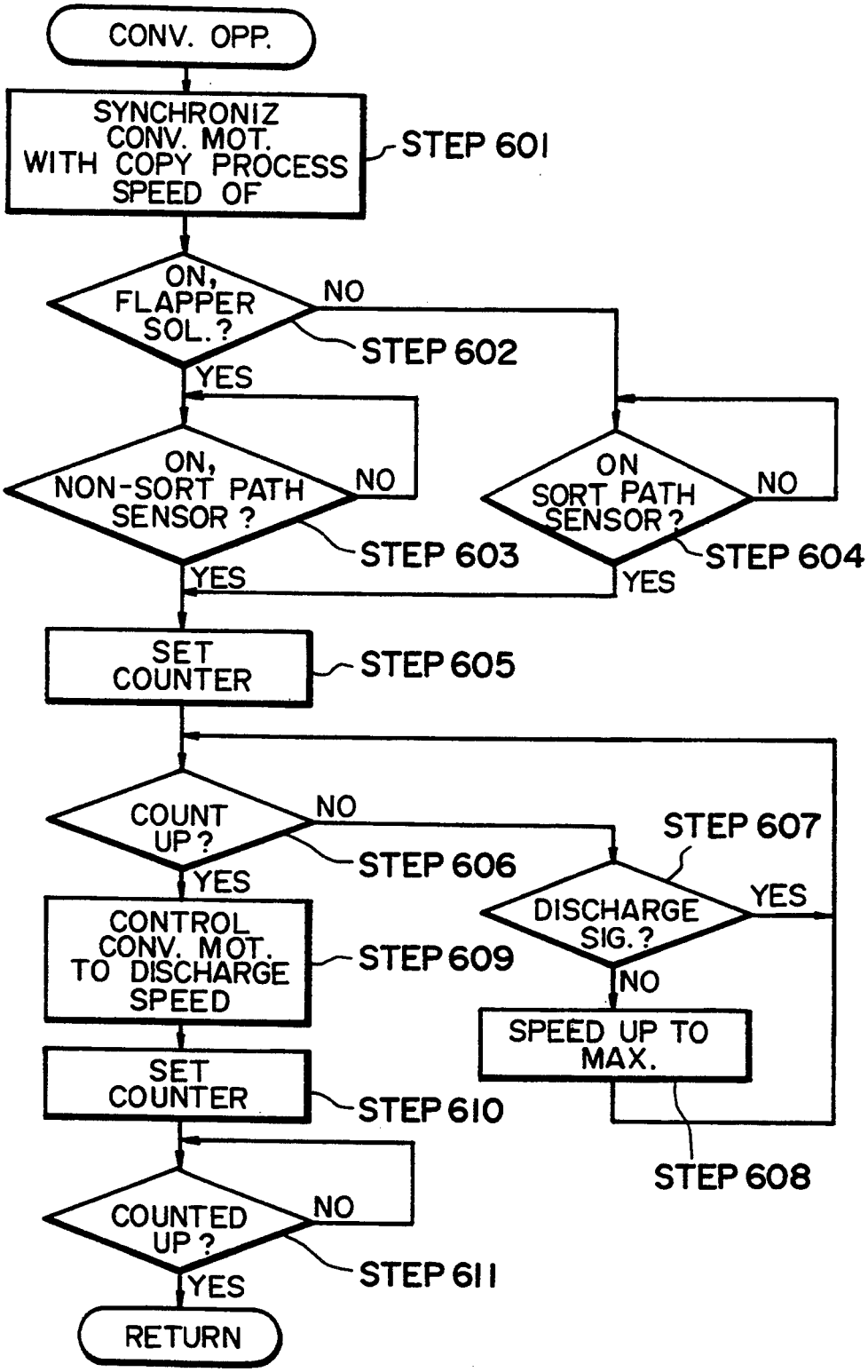

Referring to FIG. 18, the conveying operation will be described.

In the conveying operation, when the sorter 1 receives the sheet of the main assembly of the copying machine, the sheet is bent into a loop between the sorter I and the copying machine if the sheet conveying speed by the sorter 1 is lower than the sheet discharging speed of the main assembly of the copying machine, with the result of sheet jam. If, on the contrary, the sheet discharging speed of the sorter 1 is higher than the sheet discharging speed of the main assembly, the sheet is stretched, with the result of noise or tearing of the sheet. In consideration of those, the sheet conveying speed of the sorter 1 is synchronized with the process speed of the main assembly of the copying machine at step 601. Then, the discrimination is made as to whether or not the flapper solenoid 20 is energized, that is, as to which of the sorted sheet discharging outlet and the non-sorted sheet discharging outlet is selected, at step 602. If the flapper solenoid 20 is energized, it means that the non-sorted sheet discharging outlet 15 is selected, the sequence goes to step 603 wherein the non-sorted sheet passage sensor S1 operates. If, on the contrary, the flapper solenoid is deenergized, it means that the sorted sheet discharging outlet 16 is selected, and therefore, the sequence goes to step 604 wherein the sorted sheet passage sensor S2 operates. At step 603 or 604, actuation of the non-sorted sheet passage sensor S1 and the sorted sheet passage sensor S2 is awaited. After it is actuated, the sequence goes to step 605 wherein a counter is set for determining a position for controlling the conveying motor 21 when the sheet is discharged. Thereafter, the discrimination is made as to whether or not the counting of the counter set at the step 605 is completed, at step 606. If it is counted up, the sequence goes to 609. If not, the sequence goes to step 607. In the step 609, the discrimination is made as to whether or not the discharging signal is produced from the main assembly of the copying machine. Only when it is not produced, the sheet has been passed through the main assembly of the copying machine, so that the conveying speed is set to the maximum at step 608. The step 609 is effected after the controlling position determined at the step 608 is discriminated, and set the conveying motor 21 to the sheet discharging speed by the main assembly of the copying machine. Thereafter, the counter for determining the discharge completion position is set at step 610. After the counter counts up, the counting operation is completed at step 611.

Figure 19:
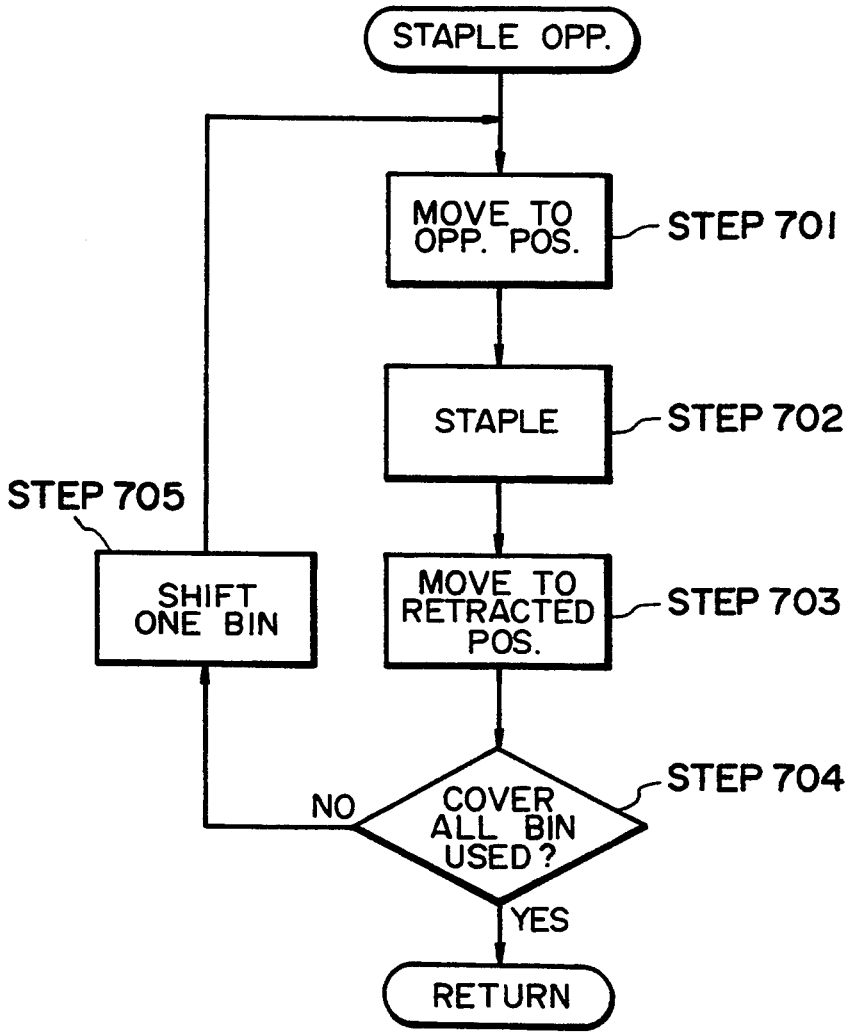

Referring to FIG. 19, the stapling operation will be described. First, at step 701, the stapler swinging motor 85 is energized so as to move the stapler 17. The energization of the stapler swinging motor 85 continues until both of the stapler operating position sensor S7 and the stapler positioning sensor S6 are actuated, that is, until the stapler 17 is moved to the operating position 17*a*. Next, the stapler motor 71 is energized to staple the sheets. Stapling operation, the stapler motor 71 is actuated, and the stapler motor 71 is deactuated after the stapler cam sensor S11 is actuated after it is deactuated, that is, after the stapler cam rotates through one full turn. Thus, one stapling action is completed, at step 702. Thereafter, the stapler swinging motor 85 is driven at step 703, until the stapler operating position sensor S7 is deactuated, and the stapler positioning sensor S6 is actuated, that is, the stapler 17 is moved to the retracted position 17*b*. Thereafter, the discrimination is made as to whether or not the sheets on all of the bins are stapled. If not, one bin shift is effected at step 705, and the sequence goes to step 701 in order to effect the next stapling action. If it is completed, the stapling action is completed. In this embodiment, the non-sorted sheet stapling button S13 is provided in the sorter 1 to staple the non-sorted sheets. However, this is not limiting, and the same operation may be effected in response to a signal from the main assembly of the image forming apparatus such as a copying machine. For example, when a non-sorting and stapling mode is set in the mode setting means in the image forming apparatus main assembly, the non-sorted sheets may be stapled in accordance with the mode setting signal supplied from the main assembly of the image forming apparatus.

Control of the lead cam 32

Referring to FIG. 20 and back to FIGS. 5 and 6, the discrimination will be made as to the control for the lead cam 32 by the control means 104 for controlling the stand-by position of the lead cam 32.

Since the engaging position between the bin roller 49 and the cam groove 32*a* and the position of the flag 55 correspond, the following description will be made with the position of the flag 55 deemed as the engaging position of the bin roller 49 in the cam groove 32*a*.

When the bin is not moved, the lead cam 32 is formally engaged with substantially the central portion of the parallel portion 32*c* of the cam groove. With this state, the flag 55, as shown in FIG. 20A, is faced to the lead cam sensor S4 at the central portion of the flag 55.

When the bin B is moved upwardly, the lead cam 32 rotates beforehand to such a position that the bin roller 45 is engaged with the neighborhood of the end portion of the parallel portion 32*c*. This is an upward movement stand-by position. Thus, the lead cam 32 rotates in the direction A from the position shown in FIG. 20A to the position shown in FIG. 20B, and is stopped at the upward movement stand-by position wherein an end 55*a* of the flag 55 is faced to the lead cam sensor S4. Referring to FIG. 21, the movement timing is indicated by a reference T1. During the bin movement, the lead cam 32 is rotated through a slightly less than one full rotation from the stand-by position shown in FIG. 20B, and it is stopped at the position shown in FIG. 20A. By this, the bin B is moved upwardly through an amount of one bin. The movement timing is indicated by a reference T2 in FIG. 21.

When the lead cam 32 starts to rotate from the upward movement stand-by position, the bin roller 49 situated adjacent the end portion of the parallel portion 32*c* of the cam groove is immediately moved to the inclined portion 32*b*. Without delay, the upward movement of the bin B is started.

Figure 20A:
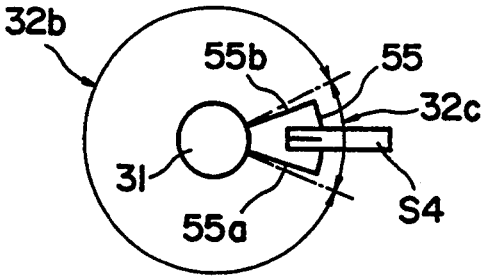
FIGS. 20(*a*), 20(*b*) and 20(*c*) are top plan views of a flag indicating the waiting state of the lead cam.
Figure 20C:
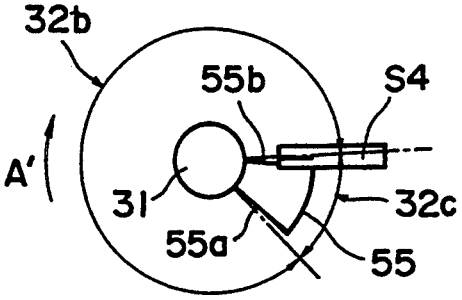
Figure 20B:
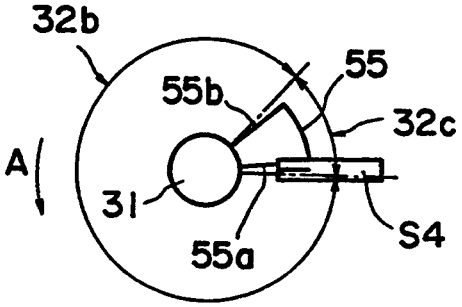
Figure 21:
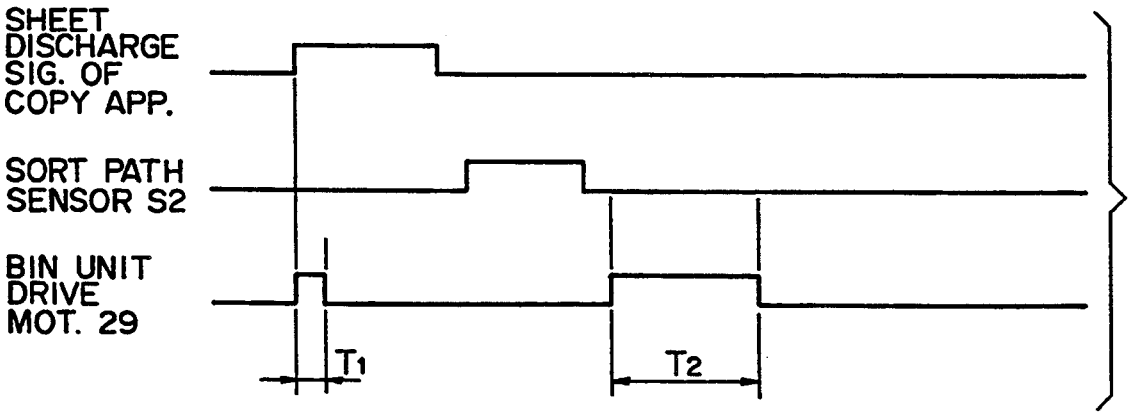
FIG. 21 is a timing chart illustrating drive of a bin unit driving motor for driving the lead cam.

Then, the lead cam 32 is moved from the position indicated in FIG. 20A to the upward movement stand-by position shown in FIG. 20B.

When the bin B is to be moved downwardly, the Lead cam 32, prior to bin movement, is moved from the position indicated in FIG. 20A in the direction A' to the downward movement stand-by position indicated in FIG. 20C, that is, the position wherein the other end 55*b* of the flag is faced to the lead cam sensor S4. And it is stopped there. Similarly to the case of the upward movement, the rotation for the bin movement is started from the downward movement stand-by position. By this, one rotation of the lead cam 32 for the bin movement is smaller than 360 degrees (360—(the parallel portion angle/2)), and therefore, the bin movement is completed during less than 360 degree rotation, whereby the bin can be moved at a high speed.

Exchange of the staples

The control device is provided with a control means for controlling the stapler moving station 88 so that the stapler 17 is moved to a staple changing position 17*a* wherein the staple exchange is easier, the position being the same as the stapling position 17*a*. When the staples are to be replenished, the control means 101 controls the stapler moving station 88 in response to a signal from the door switch S12 to move the stapler 17 to the stapler changing or replenishing position 17*a*.

Figure 22:
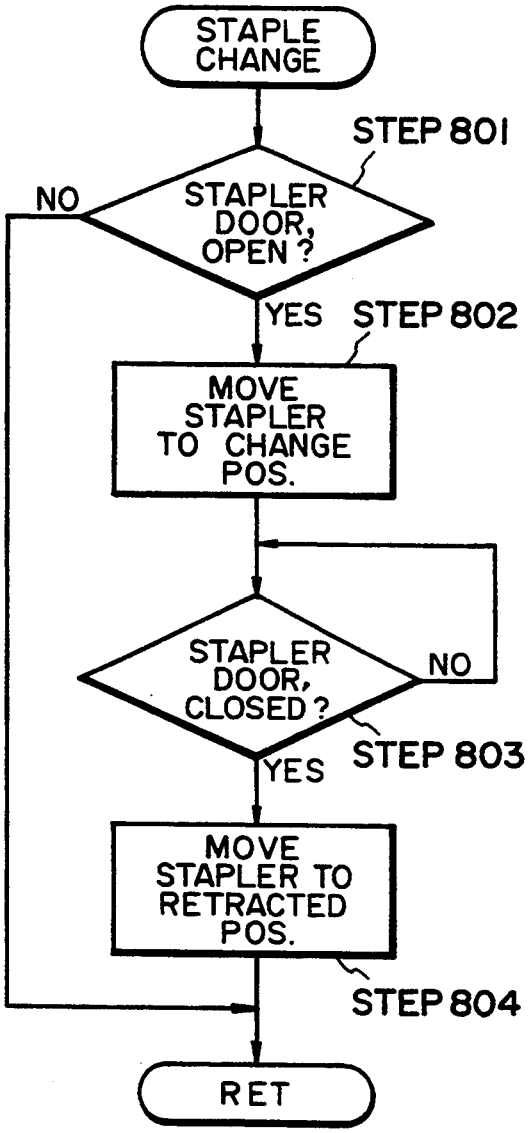
FIGS. 22–23 are flow charts illustrating operation of the sorter according to another embodiment of the present invention.

Referring to FIG. 22, the operation for the replenishment of the staples, that is, exchanging the staple cartridge 84 in this embodiment. First, at step 801, the discrimination is made as to whether or not the stapler door 18 is opened. If the stapler door 18 is closed, nothing is done. If the stapler door 18 is opened, the stapler moving station 88 is driven in response to the stapler door opening signal produced by the door switch S12 to move the stapler 17 to the staple replenishing position 17*a* which is the same as the stapling position 17*a* to allow exchange of the staple cartridge 84, at step 802. After completion of the exchange of the staple cartridge, closing of the stapler door 18 is awaited at step 803. When the stapler door 18 is closed, the stapler 17 is returned to the retracted position 17*b* at step 804. This is the completion of the staple exchange. Thus, the replenishment of the staples which has been difficult is made easier.

The stapler 17 may be provided with a sensor for detecting presence and absence of the staples in the staple cartridge 84. The embodiment of the apparatus equipped with the sensor for detecting the presence and absence of the needles will be described.

Referring back to FIGS. 7 and 10, the stapler 17 is provided with a staple detecting sensor S15 below the staple cartridge 84 so as to detect the presence or absence of the staples in the staple cartridge 84.

Figure 23:
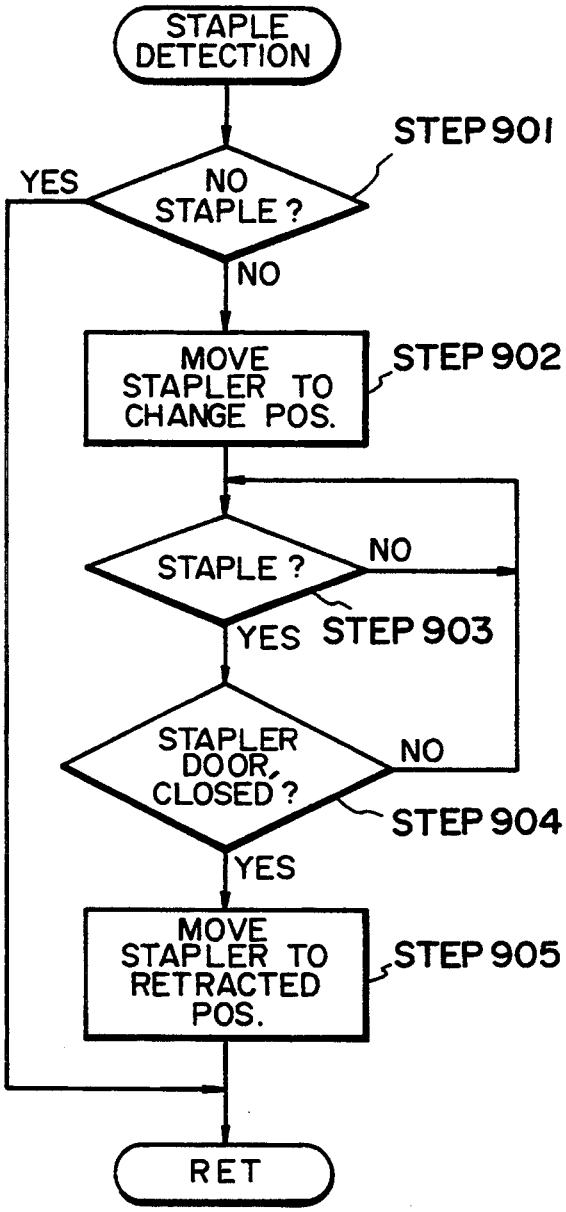

Referring to FIG. 23, the operation of this embodiment will be described. At step 901, when the stapler door 18 is opened, the detection is made as to whether or not the staples remain. If they remain, nothing is done. If no staple remains, the stapler 17 is moved to the cartridge exchanging position 17*a* since the cartridge should be exchanged, at step 902. At step 903, the discrimination is made as to whether or not the stapler 17 is replenished with the staples. At step 904, the discrimination is made as to whether or not the stapler door 18 is closed. When both of replenishment and the door closer are satisfied, the programmed sequence goes to step 905, wherein the stapler 17 is returned to the retracted position 17*b*. By this control, the stapler 17 is moved to the staple exchanging position 17*a* only when the staple cartridge 84 contains no staple, so that wasteful movement of the stapler 17 can be prevented.

A detecting means for detecting jam of a sheet may be provided, and when the jam is detected, the stapler 17 may be fixed to the retracted position 17*b*. By this, the jammed sheet is easily removed.

When the staple is jammed, the stapler 17 is preferably moved to the staple exchanging position 17*a*, since then the staple cartridge 84 is easily taken out, and therefore, the staple jam is quickly cleared.

Figure 24:
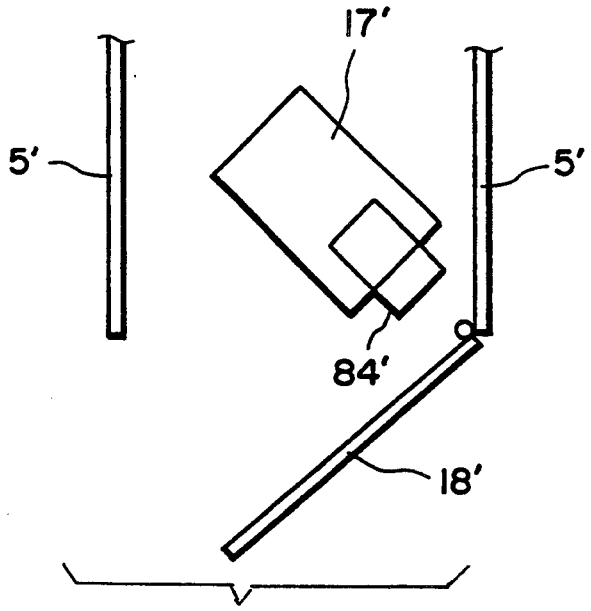
FIG. 24 is a top plan view of a stapler involving the problem of the conventional apparatus.

According to the embodiment of the present invention, as described above, the staple cartridge exchanging position is determined so as to facilitate the exchanging operation. This is advantageous over the structure shown in FIG. 24, for example, wherein the staple cartridge 84' of the stapler 17' interferes with a cover 5' or a door 18' so that it is not easily retracted with the result of difficult staple cartridge 84' exchanging operation.

Control of the alignment rod 43

The control device is provided with an alignment member movement control means 100 including such a program that at least during the bin movement, the alignment rod 43 is prevented from reaching to the aligning position 43*a* to complete the alignment operation.

Figure 25:
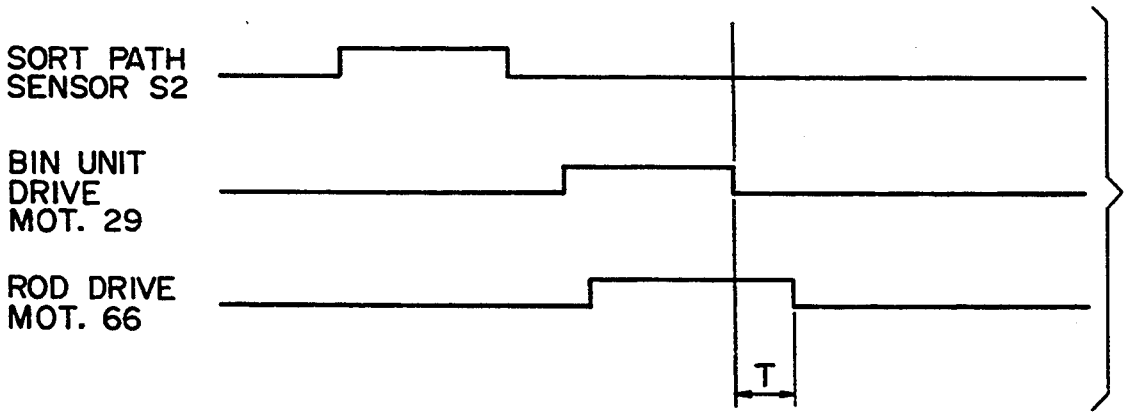
FIG. 25 is a timing chart illustrating drive of an aligning member.

As shown in FIG. 25, the control means 100 controls the alignment rod driving motor 66 such that the driving motor 66 is started after the start of the bin unit driving motor 29, and the driving of the driving motor 66 for moving the alignment rod 43 to the aligning position 43*a* is stopped after a predetermined period of time ($T \geqq 0$) after completion of the driving of the bin unit driving motor 29. By this, the alignment rod 43 reaches the aligning position 43*a* only after completion of movement of the bin B. Therefore, it is at least avoided that during the bin movement, the alignment rod 43 reaches the aligning position 43*a* to complete the aligning operation. Therefore, the alignment rod 43 is prevented from being in contact with the sheets P in the bin B which is moving to disturb the edges thereof, and therefore, the sheets P are aligned in good order.

In this embodiment, the alignment rod 43 is driven by the alignment rod driving motor 66. However, this is not limiting, and a link mechanism associated with the lead cam 32 may be employed so that the alignment rod 43 does not complete the sheet aligning operation during the bin movement, that is, the movement to the aligning position 43*a* is not completed during the bin movement.

Curl confinement

Figure 26:
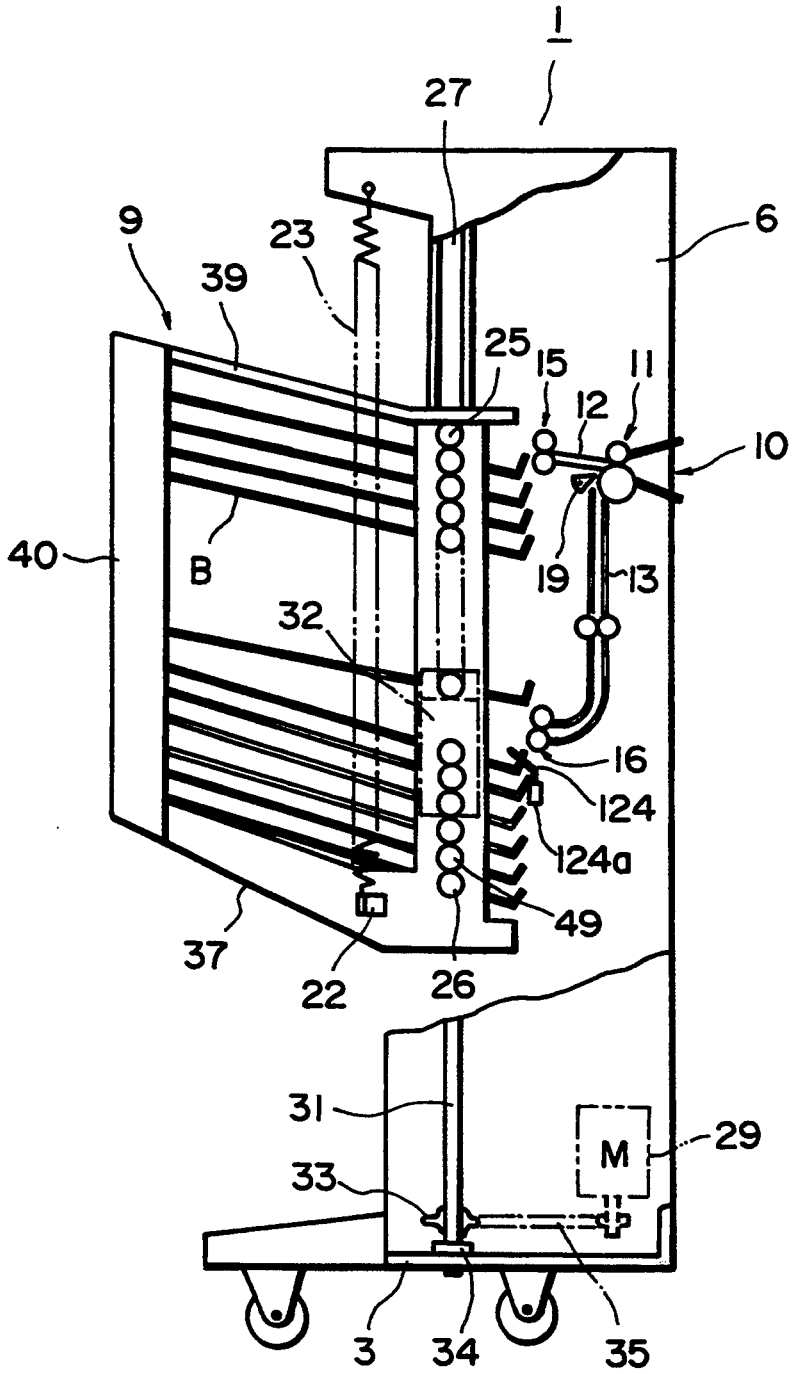
FIG. 26 is a front sectional view of a sheet finisher provided with a curl confining mechanism.

Referring to FIG. 26, the curl confinement will be described. As to the same structures as in FIG. 1, the description is omitted for simplicity. Adjacent to the discharging rollers 16, a curl confining member 124 is disposed for confining curling at a stapling portion of a sheet S received in the bin B located at the sheet receiving position for receiving the sheet discharged by the rollers 16. The curl confining member 124 is connected to the solenoid 124*a*.

The curl confining operation will be described. The operator places an original M faced up on an original carriage, and sets in the operation panel a copy processing mode for the original M, the number N of copies, sorting mode and stapling mode and others. An unshown microcomputer receiving the signals from the operation panel, discriminates whether the stapling mode is selected or not. If so, the computer deenergize an unshown solenoid to switch the flapper 19 to the conveying passage 13 side, when the operator depresses the copy start button. Then, the microcomputer rotates the lead cam 32 by the driving motor 29 until the topmost bin B reaches to a position for receiving the sheet S discharged through the discharging rollers 16. The microcomputer, in response to a signal from an unshown sensor, discriminates that the topmost bin B is detected by the sensor, and then, produces copy start signals to various portions. An unshown copying machine receiving the signal copies the original on the sheet S and discharges the sheet S after fixing the image thereon. The sheet S discharged from the copying machine is discharged to the topmost bin B. The sheet S discharged to the bin B is aligned by the alignment rod.

Figure 27:
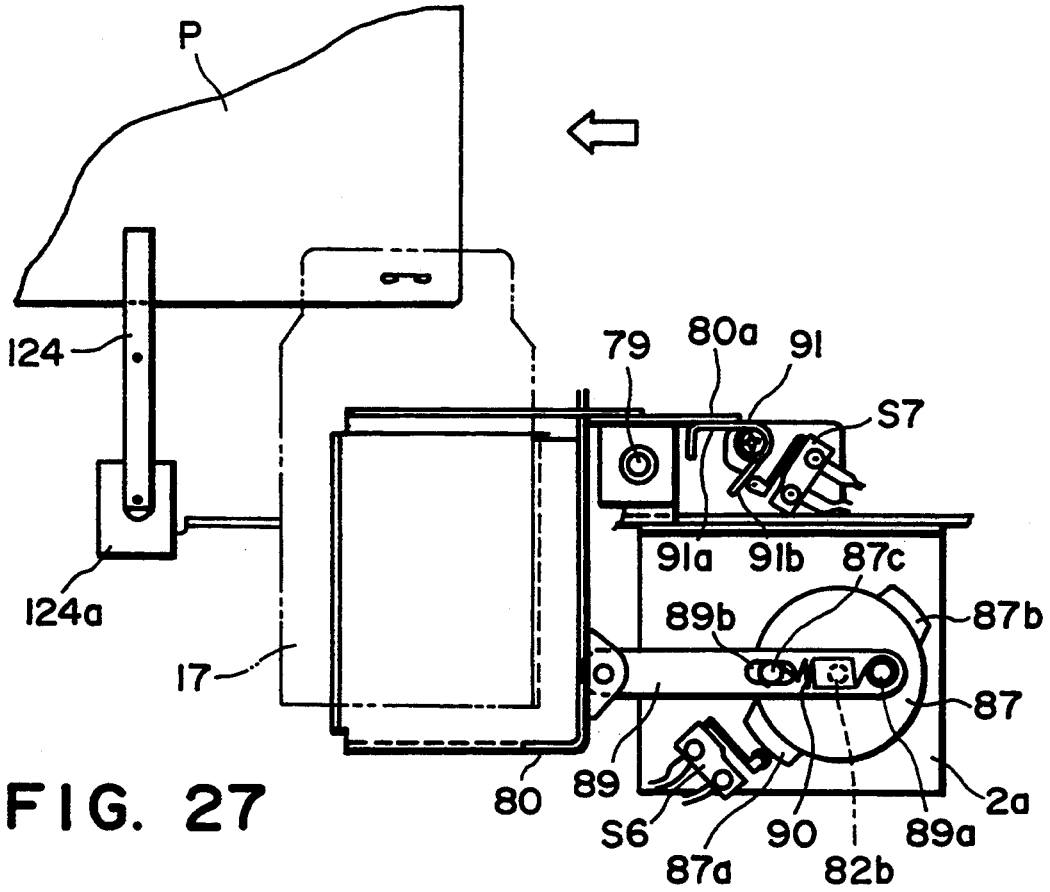
FIGS. 27–28 shows major parts of the sheet finisher according to an embodiment of the present invention.
Figure 29:
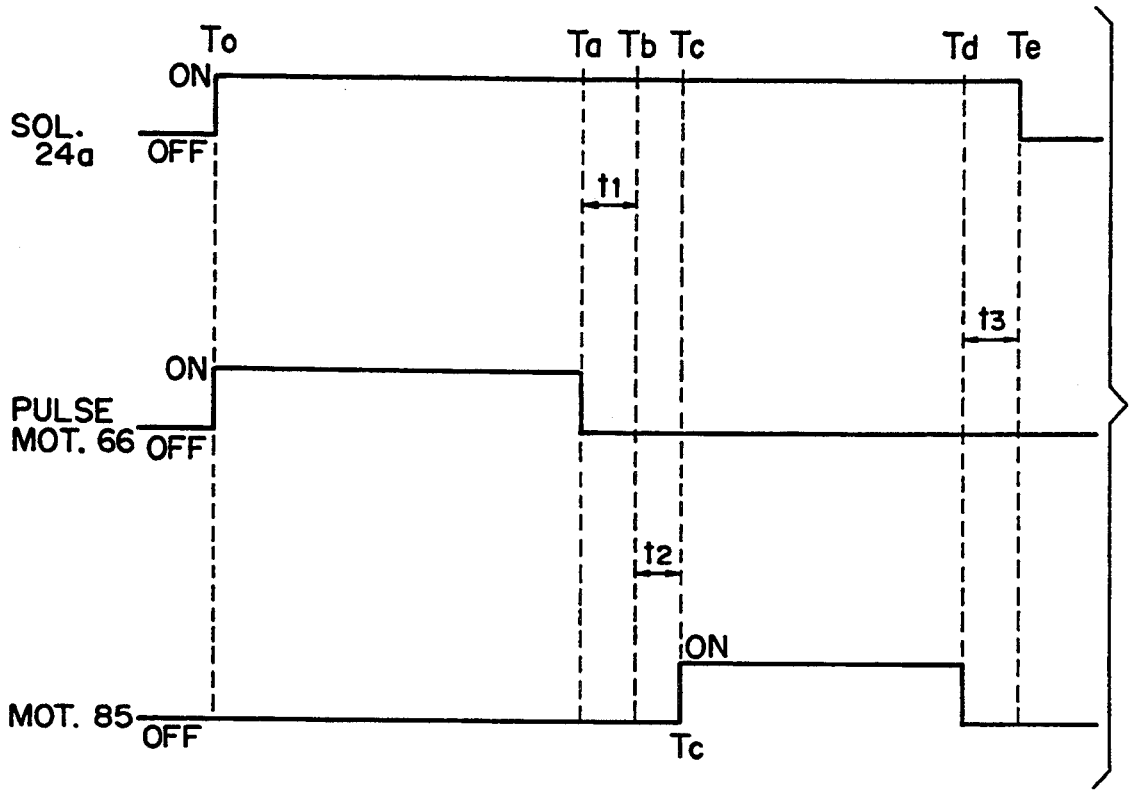
FIG. 29 is a timing chart illustrating the curl confining operation.

In this manner, the preset number of sheets S now having the copied images are sorted and accommodated in the bins B, and the copying and sorting operations are completed. Then, the microcomputer rotates by the driving motor 29 the lead cam 32 to move the topmost bin B to the stapling position, that is, the position wherein the sheet S discharged from the discharging rollers 16 is accommodated. The computer energizes the solenoid 124*a* to start to confine by the confining member 124 the curling of the stapling portion of the sheet S accommodated in the bin B (FIG. 27), and actuates the pulse motor 66 by a predetermined number of pulses to align the sheet S by the alignment rod to the alignment reference plate 41. After completion of the alignment by the alignment rod 43 (Ta, FIG. 29), the curl confining member 124 is on the way to the complete curl confining position. After a predetermined period $t_1$, that is, at the time Tb, the sheet S is completed confined. At the time Tc a predetermined period $t_2$ after the time of Tb, the microcomputer rotates the motor 85, and the rotation of the motor 85 is transmitted to the output shaft 82*b* with the reduction by the gear grain 82. By this rotation of the output shaft 82*b*, the link disk 87 is rotated, by which the cam 87*b* which is contacted to the microswitch S7 to close it when the stapler 17 is situated at the retracted position 17b (FIG. 10), is moved away from the microswitch S7 to open it. Further, the link disk 87 is rotated, and the rotation thereof is transmitted to the link arm 81 through the shaft 87c, the spring 90 and the shaft 89a. The arm 89 swings about the shaft 87c inserted in the elongated slot 89b, and moves leftwardly (FIG. 11). By the movement of the link arm 89, the swingable base 80 swings about the shaft 79. Then, the link disk 87 further rotates so that the cam portion 87a is brought into contact with the microswitch S6. When the switch S6 is actuated, the microcomputer receiving the actuation signal of the switch S6 deenergize the motor 85 to stop the link disk 87.

Figure 28:
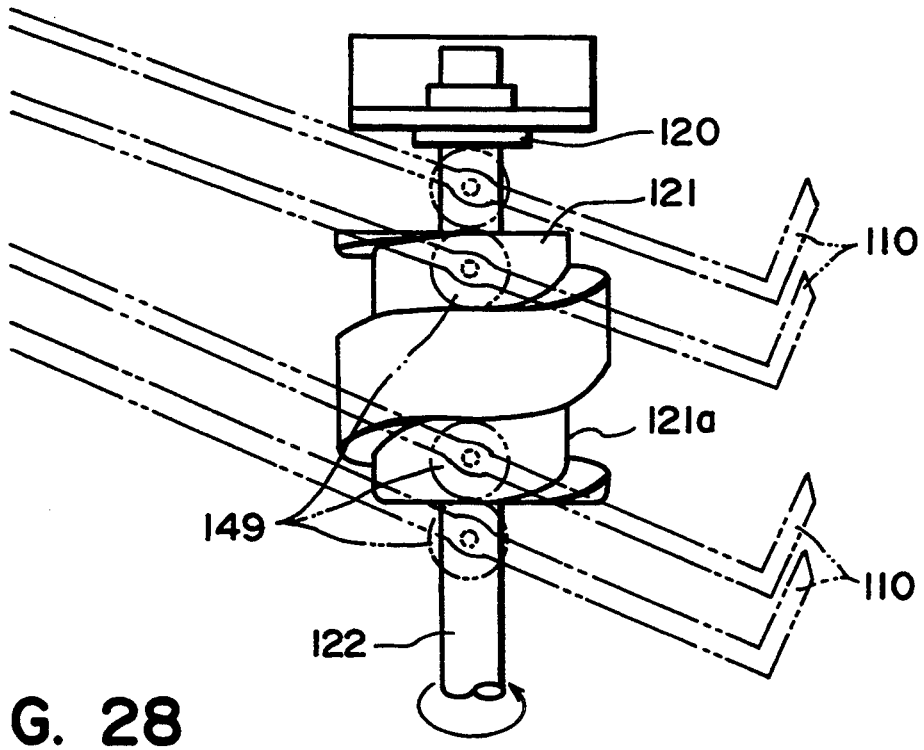

At this time, the swingable base 80 is moved to the position shown in FIG. 28, and an end 80a of the base 80 pushes an end 91 of the arm 91 to rotate the arm 91 in the counterclockwise direction. By this, the other end 91b of the arm 91 depresses the microswitch 85 to close it. The microcomputer receiving the actuation signal of the switch S7 deemed that the stapler 17 has moved to the stapling position 17a (FIG. 10). When the stapler 17 moves from the retracted position 17b to the stapling position 17a, the sheet S accommodated in the bin B is guided by the upper and lower guides 74 and 74 into between the head 76 and the anvil 77 of the stapler 17. During this movement, the trailing front side corner portion of the sheet S on the bin B relatively passes between the light emitting portion of the sheet detecting sensor S8 movable together with the swinging base 80 and the corresponding light receiving portion, by which the sheet S is detected by the sensor S8.

The sheets S on the bin B can be erroneously taken out so that the sensor S8 does not detect any sheet, the microcomputer prohibits the stapler 17 from operating, and returns it to the retracted position 17b. The microcomputer having received the signal indicative of the presence of the sheet from the sensor S8, drives the driving motor 71 to staple the sheets S on the bin B by the stapler 17.

Upon completion of the stapling operation at Td (FIG. 29), the stapler 17 is returned to the retracted position 17b. Then, the computer deenergize the solenoid 124a to move the sheet confining member 124 away from the sheet S at the time Te (FIG. 29) which is a predetermined period ($t_3$) after the time Td. The driving motor 29 rotates the lead cam 32 to move upwardly the bin B by one step, and then the stapler 17 is moved to the stapling position 17a similar to the described above. After the sheet detecting sensor S8 detects the sheet S accommodated in the second bin B now positioned to the stapling position, and thereafter, the stapling operation is effected in the similar manner.

The same operations are repeated to staple all the sets of sheets S on the bins B after the sheet detecting sensor S8 detects the respective sets of sheet, together with the upward movement of the bin step by step.

Mechanism for preventing bin movement when the stapler is at stapling position

Figure 30:
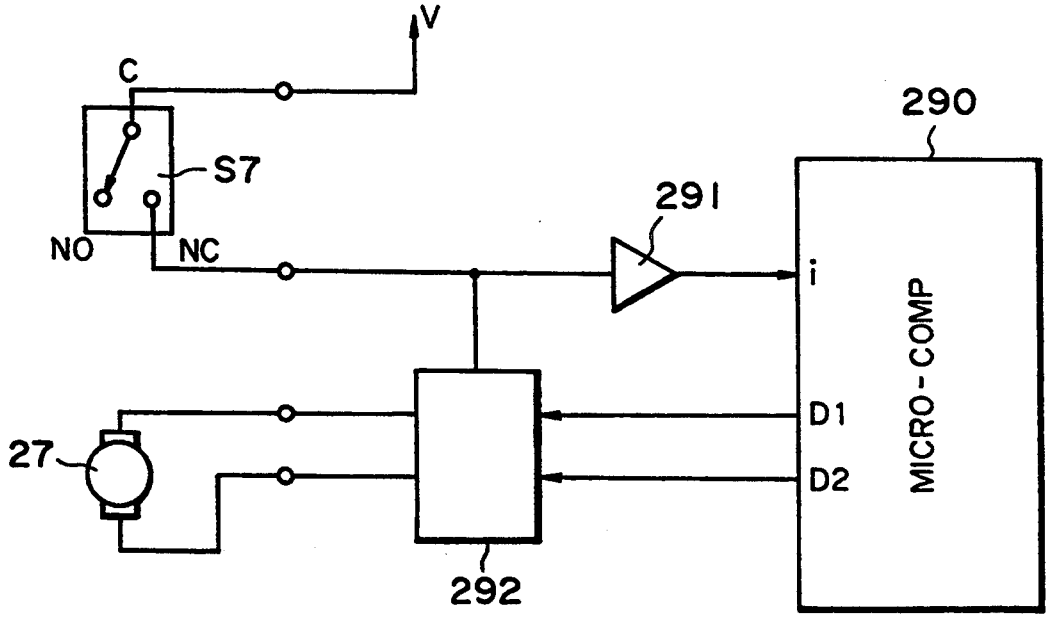
FIG. 30 is a block diagram illustrating a stapler position detector.
Figure 31:
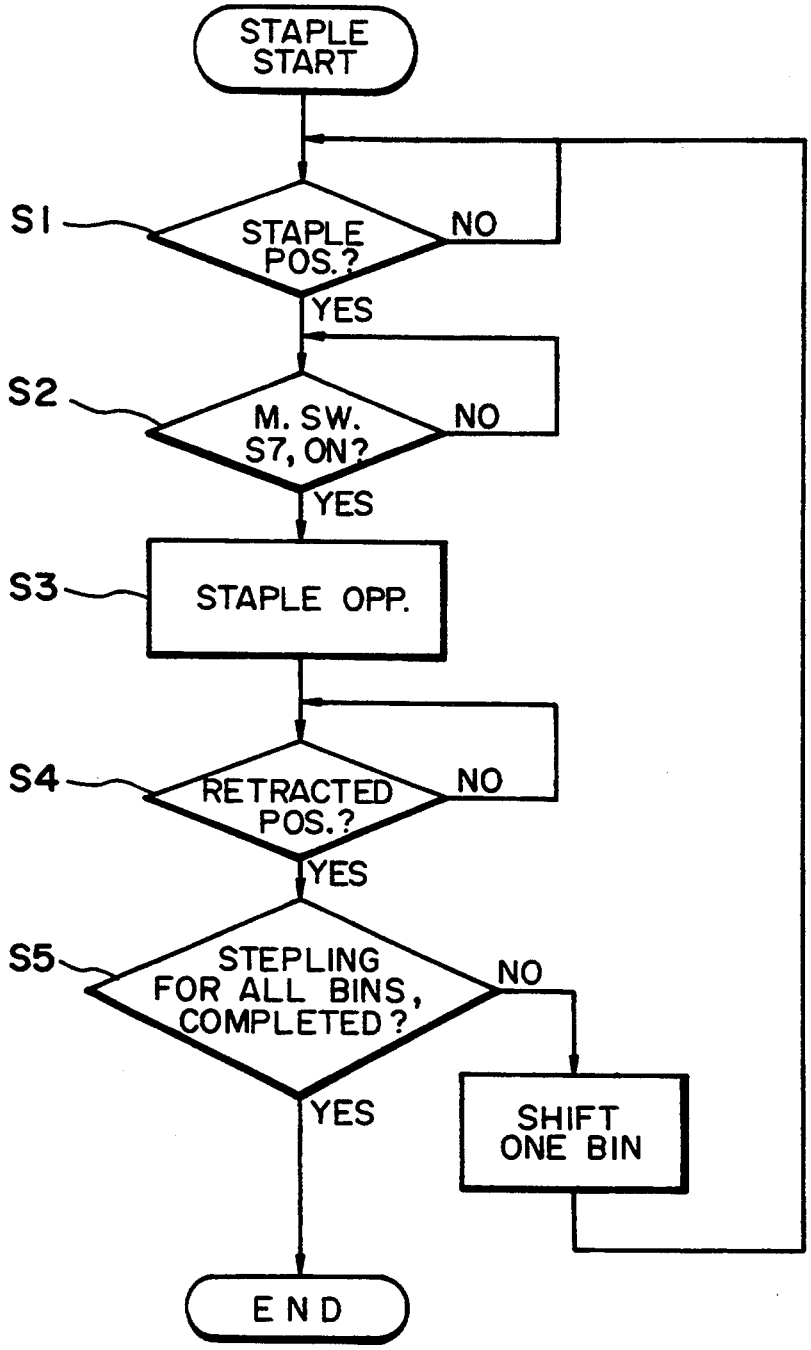
FIG. 31 is a flow chart illustrating operation of the apparatus shown in FIG. 30.
Figure 32:
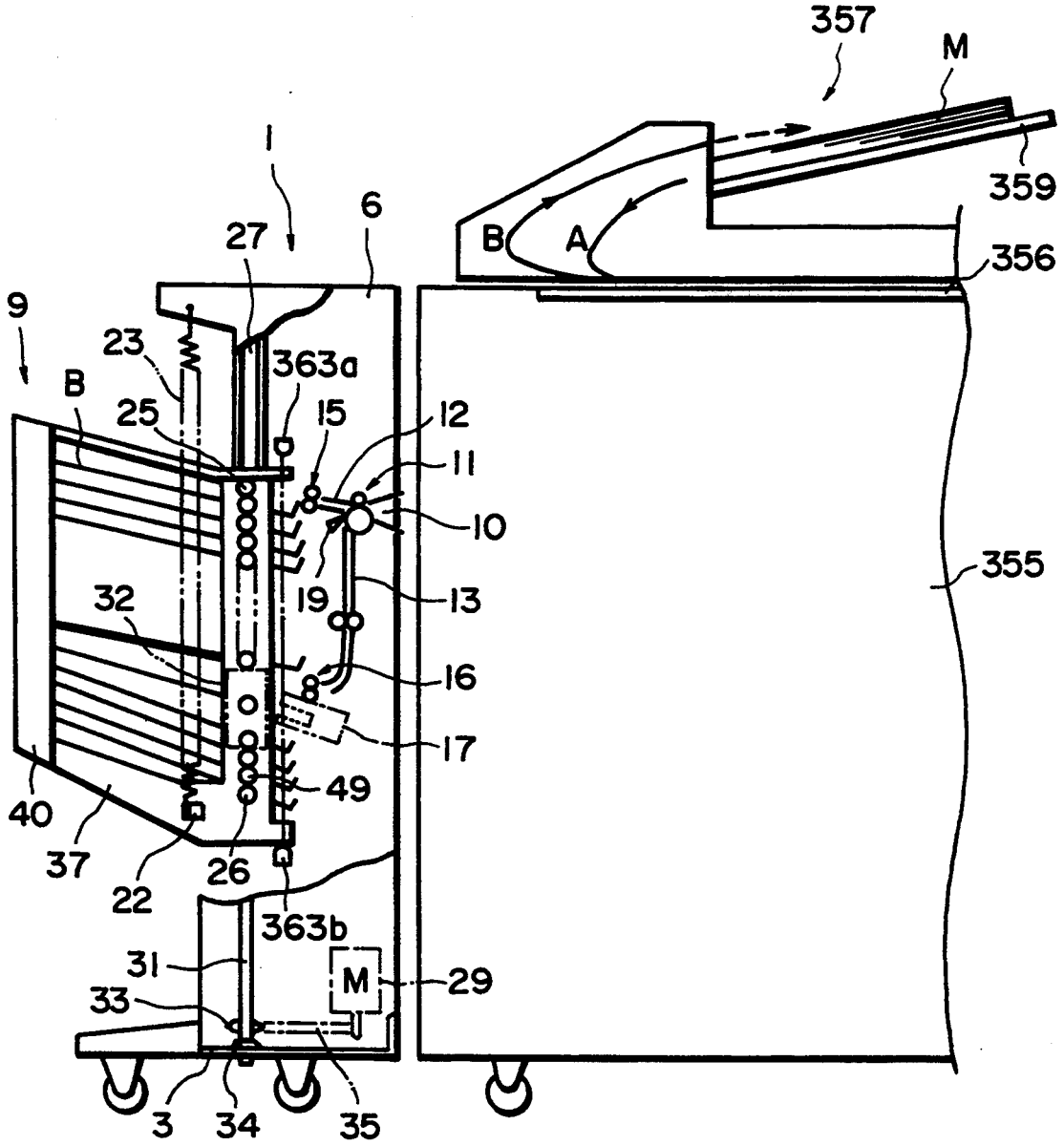
FIG. 32 is a perspective view of a sheet finisher provided with an automatic document feeder according to an embodiment of the present invention.

Referring to FIGS. 30, 31 and 32, the description will be made to the mechanism for preventing movement of the bin when the stapler is situated at the stapling position. As to the same structure as disclosed in FIGS. 1–29, the description will be omitted for the simplicity.

As shown in FIG. 30, the sorter 1 is equipped with a microcomputer 290 having an input terminal i to which an LC terminal of the microswitch S7 is connected through a buffer 291. The microcomputer 290 as output terminals d1 and d2 to which a driving circuit 292 of the driving motor 29 is connected. The driving circuit 292 is connected to the NC terminal of the microswitch S7, the NC terminal functioning as a power source. A common terminal C of the microswitch S7 is connected to a voltage source V. When the switch S7 is opened, the common terminal C is connected to the NC terminal.

Referring to FIG. 31 which is a flow chart, the operation of the apparatus of this embodiment will be described.

The operator places an original M face up on an original tray 359, and sets in the operation panel of the copying machine a copy processing mode for the original M, the number N of copies, the sorting mode, the stapling mode or the like. The microcomputer 290 receiving the signal from the operation panel, discriminates whether or not the stapling mode is selected. If so, the computer deenergize an unshown solenoid to switch the flapper 19 to the conveying passage 13 side when the operator depresses the copy start button. The microcomputer 290 rotates the lead cam 32 until the driving motor 29 moves the topmost bin B to such a position as to receive the sheet S discharged through the discharging rollers 16 by way of a driving circuit 392 connected to a voltage source V through the NC terminal and the common terminal C when the microswitch S7 is open. The microcomputer 290, in response to a signal from an unshown sensor, discriminate that the topmost bin B is detected by the sensor, and then, copy start signals are produced to various parts. The copying machine 355 receiving the signal produces a copied image on the sheet S, and the sheet S is discharged after the image is fixed thereon. The sheet S discharged from the copying machine is introduced into the main assembly 6 by the pair of inlet rollers 11 through the inlet 10, and it is conveyed to the flapper 19 by the roller pair 11. Then, the sheet S is guided into the conveying passage 18 by the flapper 19, and is discharged only the topmost bin B of the bin unit 9 through the passage 13, the topmost bin B being below the discharging roller pair 16. The sheet S discharged to the bin B is aligned by the alignment rod 43.

In this manner, a preset number of copy sheets S are produced and are sorted and accommodated on the bins B, thus completing the copying and sorting operation. Then, the microcomputer 290 energizes the driving motor 29 to rotate the lead cam 32 so as to move the topmost bin B to the stapling position, that is, the position where the sheet S discharged by the discharging roller pair 16 is accommodated (S1). Then, the computer 290 rotates the motor 85, and the rotation of the motor 85 is transmitted to the output shaft 82b with reduction by the gear tray 82. Then, the link disk 87 is rotated by the rotation of the output shaft 82b. By the rotation of the disk 87, the cam portion 87b which is contacted to the microswitch S7 to close the switch S7 when the stapler 17 is situated at the retracted position 17b (FIG. 10), is moved away from the switch S7 to open the switch S7. When the link disk 87 rotates, the rotation of the disk 87 is transmitted to the link arm 89 through the spring 90 and the shaft 89a. The arm 89 swings about the shaft 87c inserted through the elongated slot 89b, and moves leftwardly (FIG. 11). By the movement of the link arm 89, the swingable base 80 swings about the shaft 79. Then, the link disk 87 further rotates so that the cam portion 87a is contacted to the microswitch S7, and when the switch S7 is actuated, the microcomputer 290 having received the on-signal from the switch S7 deenergize the motor 85 to stop link disk 87. At this time, the swingable base 80 is moved to the position shown in FIG. 11, and an end 80*a* of the base 80 pushes an end 91*a* of the arm 91 to rotate the arm 91 in the counterclockwise direction. By this, the other end 91*b* of the arm 91 depresses the microswitch S7 to close the switch S7, that is, connect the common terminal C and the NC terminal, by which the on-signal of the switch S7 is transmitted to the microcomputer 290 through the butter 291. Then, the microcomputer deems that the stapler 17 has moved to the stapling position 17*a* (FIG. 27) (S2).

At this time, by the common terminal C being disconnected from the NC terminal, the driving circuit 292 is disconnected from the voltage source V, and therefore, even if a driving signal is introduced into the driving circuit 292 by an erroneous operation of the microcomputer 290, the driving motor 29 is not started.

The microcomputer 290 receiving the signal indicative of the presence of the sheet from the sensor S8 drives the driving motor 71 to staple the sheets S on the bin B by the stapler 17 (S3). Upon completion of the stapling action, the stapler 17 is returned to the retracted position (S4). Then, the computer drives the driving motor 29 to rotate the lead cam 32 to move upwardly the bin B by one step. The stapler 17 is, similarly to the above, moved to the stapling position 17*a*, and the sheet S accommodated in the second bin now placed at the stapling position are stapled after the presence thereof is confirmed by the sheet detecting sensor S8. By repeating the same operation, the bin is moved upwardly step by step, and the all the sets of sheet on the bins B are stapled after the presence of the respective sets of sheets detected by the sheet detecting sensor S8. Then, the staling action is completed (S5).

In the foregoing embodiment, the stapler 17 is swingingly moved between the stapling position 17*a* and the retracted position 17*b* by the link mechanism. However, this is not limiting, and a stepping motor may be employed with a lack and pinion gears for linearly moving the stapler 17 between the stapling position 17*a* and the retracted position 17*b* not interfering with movement of the bins B.

While the invention has been described with reference to the structures disclosed herein, it is not confined to the details set forth and this application is intended to cover such modifications or changes as may come within the purposes of the improvements or the scope of the following claims.

What is claimed is:

1. A sheet sorter comprising:

bin means including a plurality of bins for accommodating sorted sheets, wherein said bins sequentially receive copy sheets having the same copy image with stepping movements thereof, and the operation is repeated to sort the copy sheets on the bins;

sheet stacking means for accommodating the copy sheets without sorting;

sheet switching means for selectively guiding the sheets to said plural bins or to said sheet stacking means;

staple means for stapling the sheets accommodated in the bins, for each of the bins;

control means for controlling said sheet switching means to direct the sheet to said bins in response to instructions for sorting and stapling the sheets, to direct the sheet to said sheet stacking means in response to instructions for accommodating the sheets without sorting, and to direct the sheets to that one of said bins in response to instructions for stapling the sheets without sorting;

aligning means for abutting edges of the sheets accommodated in said bins to align the sheets;

driving means for driving said aligning means between an aligning position for aligning the sheets and a position away from the sheets; and second control means for controlling said driving means to start the driving of said driving means during movement of said bins and to move said aligning means to the aligning position to complete an aligning operation after completion of the movement of said bins.

2. An apparatus according to claim 1, wherein an inlet for directing the sheets to said bins is fixed, and said bins are substantially vertically movable relative to the inlet.

3. An apparatus according to claim 2, wherein said stapling means is placed at a position corresponding to the inlet to staple the sheets in one of said bins faced to the inlet.

4. An apparatus according to claim 1, further comprising a first sheet inlet for directing the sheets into said plural bins and a second sheet inlet for directing the sheets to said sheet stacking means, wherein said sheet switching means is disposed upstream of said first and second sheet inlets with respect to movement direction of the sheets.

5. An apparatus according to claim 4, wherein said first sheet inlet is disposed at a lower portion of said apparatus, and said second sheet inlet is disposed at an upper portion, and wherein said stapling means is disposed at a position corresponding to said first sheet inlet.

6. An apparatus according to claim 5, wherein said sheet stacking means is substantially vertically movable together with said plural bins, and wherein said sheet stacking means is moved to a position corresponding to said second sheet inlet when a non-sorting mode is selected, and the topmost bin of said plural bins is moved to a position corresponding to said first sheet inlet when a sorting mode is selected.

7. An apparatus according to claim 6, wherein said sheet stacking means is disposed adjacent a top one of said plural bins.

8. An apparatus according to claim 1, further comprising driving means for moving said stapling means at least between a stapling position for stapling the sheets and a retracted position, and control means for controlling said stapler driving means to move said stapling means to a staple exchanging position suitable for staple replenishment.

9. An apparatus according to claim 8, wherein the staple exchanging position is the same as the stapling position.

10. An apparatus according to claim 1, further comprising:

curl confining means for confining curling of the sheets accommodated in said bins; and third control means for controlling said curl confining means and said aligning means so that completion of a curl confining operation of said curl confining means is later than completion of the aligning operation of said aligning means.

11. An apparatus according to claim 1, further comprising:

stapler moving means for moving said stapling means between a stapling position for stapling the sheets accommodated in said bin;

curl confining means for confining curling of the sheet accommodated in said bin; and third control means for controlling said curl confining means and said stapling means so that said stapling means is moved to the stapling position after said curl confining means confines curling of the sheet.

12. A sheet sorter comprising:

bin means including a plurality of bins for accommodating sorted sheets, wherein said bins sequentially receive copy sheets having the same copy image with stepping movements thereof, and the operation is repeated to sort the copy sheets on the bins;

sheet stacking means for accommodating the copy sheets without sorting;

sheet switching means for selectively guiding the sheets to said plural bins or to said sheet stacking means;

staple means for stapling the sheets accommodated in the bins, for each of the bins;

control means for controlling said sheet switching means to direct the sheet to said bins in response to instructions for sorting and stapling the sheets, to direct the sheet to said stacking means in response to instructions for accommodating the sheets without sorting, and to direct the sheets to that one of said bins in response to instructions for stapling the sheets without sorting;

aligning means for abutting edges of the sheets accommodated in said bins to align the sheets;

driving means for driving said aligning means between an aligning position for aligning the sheets and a position away from the sheets; and second control means for controlling said driving means to start the driving of said driving means during movement of said bin and to move said aligning means to the aligning position to complete an aligning operation after completion of the movement of said bins;

said sheet sorter further comprising:

a cam follower provided in each of said bins;

a helical cam engageable with said cam follower and having an inclined portion for moving said cam follower during its rotation and a parallel portion not moving said cam follower during its rotation;

cam driving means for driving said helical cam selectively in a forward or backward direction; and third control means for controlling said cam driving means to slightly rotate the helical cam to an upward movement stand-by position which is in the parallel portion adjacent to such a side of inclined portion as to move said bins upwardly, when a bin upward movement mode is selected, and to slightly rotate in an opposite direction to move the cam follower to a downward movement stand-by position which is in the parallel portion adjacent such a side of the inclined portion as to move said bins downwardly when a bin downward movement is selected.

13. An image forming apparatus comprising:

an original feeder for feeding one by one stacked originals to an original reading station;

image forming means for reading each of the originals a preset number of times to provide the preset number of copy sheets having the same copy image;

bin means including a plurality of bins for accommodating sorted sheets, wherein said bins sequentially receive copy sheets having the same copy image with stepping movements thereof, and the operation is repeated to sort the copy sheets on the bins;

sheet stacking means for accommodating the copy sheets without sorting;

sheet switching means for selectively guiding the sheets to said plural bins or to said sheet stacking means;

staple means for stapling the sheets accommodated in the bins, for each of the bins;

control means for controlling said sheet switching means to direct the sheet to said bins in response to instructions for sorting and stapling the sheets, to direct the sheet to said sheet stacking means in response to instructions for accommodating the sheets without sorting, and to direct the sheets to that one of said bins in response to instructions for stapling the sheets without sorting;

aligning means for abutting edges of the sheets accommodated in said bins to align the sheets;

driving means for driving said aligning means between an aligning position for aligning the sheets and a position away from the sheets; and second control means for controlling said driving means to start the driving of said driving means during movement of said bins and to move said aligning means to the aligning position to complete an aligning operation after completion of the movement of said bins.

14. A sheet sorter, comprising:

bin means including a plurality of bins for accommodating sorted sheets, wherein said bins sequentially receive copy sheets having the same copy image with stepping movements thereof, and the operation is repeated to sort the copy sheets on the bins;

aligning means for abutting edges of the sheets accommodated in said bins to align the sheets;

driving means for driving said aligning means between an aligning position for aligning the sheets and a position away from the sheets; and control means for controlling said driving means to start the driving of said driving means during the movement of said bins and to move said aligning means to the aligning position to complete an aligning operation after completion of the movement of said bins.

15. An image forming apparatus, comprising:

an original feeder for feeding one by one stacked originals to an original reading station;

image forming means for reading each of the originals a preset number of times to provide the preset number of copy sheets having the same copy image;

bin means including a plurality of bins for accommodating sorted sheets, wherein said bins sequentially receive copy sheets having the same copy image with stepping movements thereof, and wherein the operation is repeated to sort the copy sheets on the bins;

aligning means for abutting edges of the sheets accommodated in said bins to align the sheets;

driving means for driving said aligning means between an aligning position for aligning the sheets and a position away from the sheets; and control means for controlling said driving means to start the driving of said driving means during movement of said bins and to move said aligning means to the aligning position to complete an aligning operation after completion of the movement of said bins.

16. An image forming apparatus, comprising:

image forming means for reading each of the originals a preset number of times to provide the preset number of copy sheets having the same copy image;

bin means including a plurality of bins for accommodating sorted sheets, wherein said bins sequentially receive copy sheets having the same copy image with stepping movements thereof, and wherein the operation is repeated to sort the copy sheets on the bins;

aligning means for abutting edges of the sheets accommodated in said bins to align the sheets;

driving means for driving said aligning means between an aligning position for aligning the sheets and a position away from the sheets; and control means for controlling said driving means to start the driving of said driving means during movement of said bins and to move said aligning means to the aligning position to complete an aligning operation after completion of the movement of said bins.

17. A sheet sorter, comprising:

sheet discharge means for discharging sheets;

bin means including a plurality of bins for accommodating sorted sheets, wherein said bins sequentially receive copy sheets discharged from the sheet discharge means and having the same copy image with stepping movements thereof, and the operation is repeated to sort the copy sheets on the bins;

aligning means for abutting edges of the sheets accommodated in said bins to align the sheets;

driving means for driving said aligning means between an aligning position for aligning the sheets and a waiting position away from the sheets; and control means for controlling said driving means to start moving said aligning means to the aligning position from the waiting position in one continuous movement before completion of the movement of such one of said bins as is opposed to said sheet discharge means and to finish moving said aligning means to the aligning position and thereby end said one continuous movement after completion of the movement of said one of the bins.

18. An image forming apparatus, comprising:

sheet discharge means for discharging sheets;

image forming means for reading each original a preset number of times to provide the preset number of copy sheets having the same copy image;

bin means including a plurality of bins for accommodating sorted sheets, wherein said bins sequentially receive copy sheets discharge from said sheet discharge means and having the same copy image with stepping movements hereof, and wherein the operation is repeated to sort the copy sheets on the bins;

aligning means for abutting edges of the sheets accommodated in said bins to align the sheets;

driving means for driving said aligning means between an aligning position for aligning the sheets and a waiting position away from the sheets; and control means for controlling said driving means to start moving said aligning means to the aligning position from the waiting position in one continuous movement before completion of the movement of such one of said bins as is opposed to said sheet discharge means and to finish moving said aligning means to the aligning position and thereby end said one continuous movement after completion of the movement said one of the bins.

* * * * *

UNITED STATES PATENT AND TRADEMARK OFFICE

CERTIFICATE OF CORRECTION

PATENT NO. : 5,382,016

DATED : January 17, 1994

INVENTOR(S) : KENJI KOBAYASHI, ET AL.

It is certified that error appears in the above-indentified patent and that said Letters Patent is hereby corrected as shown below:

Item [57] ABSTRACT,
line 1, "with" should read --which--.

Figure 12,
"STAPLER SHEE" should read --SHEET DET.--.

Figure 15,
"ELAPPER" should read --FLAPPER--.

Figure 18,
"SYNCHRONIZ" should read --SYNCHRONIZE--.

Figure 31,
"STEPLING" should read --STAPLING--.

Column 1,
line 50, "sheet," should read --sheets,--.

Column 3,
line 36, "shows" should read --show--.

Column 8,
line 41, "rode 43." should read --rod 43.--.

Column 9,
line 17, "criminate" should read --criminated--.

Column 10,
line 49, "I" should read --1--.

UNITED STATES PATENT AND TRADEMARK OFFICE

CERTIFICATE OF CORRECTION

PATENT NO. : 5,382,016

DATED : January 17, 1994

INVENTOR(S) : KENJI KOBAYASHI, ET AL.

It is certified that error appears in the above-indentified patent and that said Letters Patent is hereby corrected as shown below:

Column 12,
line 33, "Lead" should read --lead--.

Column 14,
line 28, "deenergize" should read --deenergizes--.

Column 15,
line 13, "deenergize" should read --deenergizes--;
line 17, "end 91" should read --end 91a--;
line 21, "deemed" should read --deems--;
line 43, "deenergize" should read --deenergizes--; and
line 56, "sheet," should read --sheets,--.

Column 16,
line 18, "deenergize" should read --deenergizes--; and
line 28, "discriminate" should read --discriminates--.

Column 17,
line 1, "deenergize" should read --deenergizes--;
line 10, "butter 291." should read --buffer 291.--;
line 32, "and the" should read --and--, and "sheet" should read --sheets--; and
line 35, "staling" should read --stapling--.

Signed and Sealed this

Ninth Day of May, 1995

Bruce Lehman

*Attest:*

BRUCE LEHMAN

*Attesting Officer*

*Commissioner of Patents and Trademarks*